United States Patent [19]

Rademaker et al.

[11] Patent Number: 4,521,954

[45] Date of Patent: Jun. 11, 1985

[54] METHOD FOR MAKING A DRY TYPE TRANSFORMER

[75] Inventors: Leo C. Rademaker; Philip J. Hopkinson; Gordon M. Bell, all of Fort Wayne; Noah D. Hay, Huntertown, all of Ind.

[73] Assignee: General Electric Company, New York, N.Y.

[21] Appl. No.: 512,735

[22] Filed: Jul. 11, 1983

[51] Int. Cl.[3] ..... H01F 41/06

[52] U.S. Cl. ..... 29/605; 29/606

[58] Field of Search ..... 29/605, 606, 602 R; 336/60, 205, 206, 207

[56] References Cited

U.S. PATENT DOCUMENTS

| | | | |
|---|---|---|---|
| 2,628,273 | 2/1953 | Somerville . | |
| 3,037,177 | 5/1962 | Marsh et al. . | |
| 3,170,225 | 2/1965 | Gray et al. | 29/605 |
| 3,200,357 | 8/1965 | Olsen et al. | 29/605 X |
| 3,212,042 | 10/1965 | Twomey . | |
| 3,214,718 | 10/1965 | Graham . | |
| 3,477,053 | 11/1969 | Burkhardt et al. . | |
| 3,559,126 | 1/1968 | Drautman, Jr. . | |
| 3,662,461 | 5/1972 | Lake et al. | 29/605 |
| 3,810,303 | 5/1974 | Hoell | 29/605 |
| 4,337,569 | 7/1982 | Pierce | 29/605 |

*Primary Examiner*—Carl E. Hall

*Attorney, Agent, or Firm*—Walter C. Bernkopf; Richard A. Menelly; John M. Stoudt

[57] ABSTRACT

A dry type, air cooled transformer having a mitered magnetic core and a compression bonded coil. In the disclosed embodiment, the magnetic core comprises a plurality of stacked lamination layers wherein each layer comprises a plurality of grain-oriented laminations wherein the ends of most of the laminations are mitered thereby resulting in joints between the leg and yoke pieces oriented at an angle to the favored magnetic directions of the adjoining laminations. The coil on each of the core legs is generally rectangular in shape and comprises a plurality of layers of wound conductor with the conductor layers in the end portions of the coil being spaced apart to form a plurality of air ducts for the passage of cooling air therethrough. The conductor layers in each of the side portions of the coil are compressed and then bonded together in their compressed state by means of a heat cured adhesive coated on opposite sides of the sheets of insulation between adjacent layers. This compression bonding of the coil sides squares up the inner and outer surfaces of the coil so as to improve the coil and core space factors thereby allowing a smaller core. Conversely, compression bonding allows higher output power ratings to be achieved by packing added conductor material through the same size core window. The compression bonding of the coil also permits duct spacers in the corners of the end ducts to be eliminated so that the duct spacing can be achieved by a single duct spacer located in the center portion of each duct thereby resulting in better conduction of heat from the coil sides to the ducted end portions of the coil.

15 Claims, 32 Drawing Figures

FIG. 25
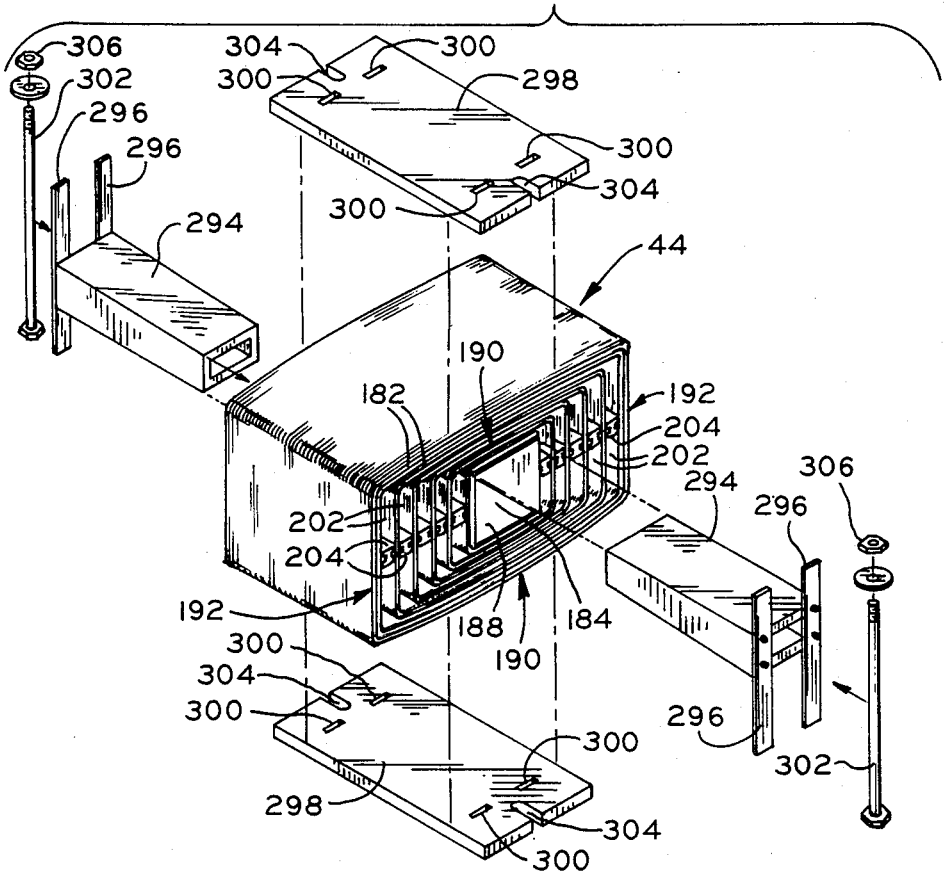
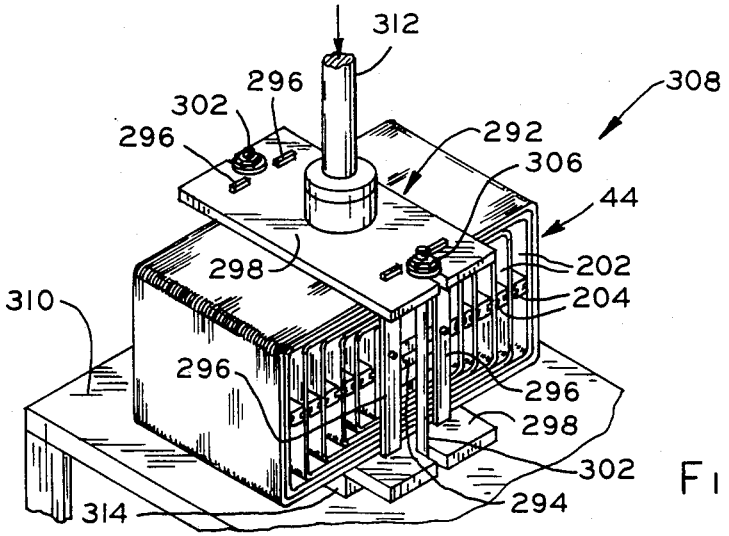
FIG. 26

METHOD FOR MAKING A DRY TYPE TRANSFORMER

CROSS REFERENCE TO RELATED APPLICATIONS

The subject matter of this application is related to the following commonly assigned applications which were all filed on the same day with the respective disclosures being incorporated herein by reference:

Ser. No. 512,737, filed July 11, 1983, Ducted and Compression Bonded Transformer and Method of Making Same, Gordon M. Bell, Philip J. Hopkinson, Noah D. Hay.

Ser. No. 512,736, filed July 11, 1983, Dry Type Transformer Having Improved Ducting, Noah D. Hay.

Ser. No. 512,738, filed July 11, 1983, Method of Making a Ducted Dry Type Transformer, Noah D. Hay, James M. Closson.

Ser. No. 512,886, filed July 11, 1983, Transformer Having Improved Space Factor and Method of Making Same, Philip J. Hopkinson, Gordon M. Bell.

FIELD OF THE INVENTION

The present invention relates to a single phase or multiple phase electrical transformer of the dry type, that is, the transformer is not immersed in oil or another cooling medium, but is exposed to ambient air in use. In particular, the invention relates to a transformer of this type having a mitered magnetic core and a compression bonded coil with improved ducting, and also to the method for making such a transformer.

BACKGROUND OF THE INVENTION

In general, a transformer of the type with which the present application is concerned comprises a magnetic core having a plurality of leg pieces and yoke pieces connecting the leg pieces to form a generally rectangular flux path surrounding a window. In the case of a three phase transformer, the magnetic core will comprise three leg pieces and four yoke pieces and will have two core windows. Supported on each of the leg pieces will be a coil having a high voltage winding and a low voltage winding each comprising one or more layers of aluminum or copper conductor wound around a coil window that is dimensioned to be mounted on the respective core leg. Electrical connections are made to the high voltage and low voltage windings to accomplish the desired step up or step down in voltage between the input and output.

From the standpoint of cost, it is highly desirable to achieve an output of the transformer, which is typically expressed in kilovolt-amperes (KVA), with a minimum of material. The output in terms of kilovolt-amps from a transformer is defined by the following formula:

$$KVA = \frac{f\,B\,J\,A_1\,S_1\,A_2\,S_2}{4.5 \times 10^7}$$

Where f=frequency, hz

B=flux density in the core, kl/in$^2$

J=current density in the conductor, amp/in$^2$ $A_1$=core window cross section, in$^2$ $S_1$=coil space factor within core window $A_2$=coil window cross section, in$^2$ $S_2$=core space factor within coil window Basically, the flux density is the amount of flux per cross sectional area flowing through the core, the current density is the amount of amperage per cross-sectional area flowing in the wound conductor in the coil, and the space factors are measures of the utilization of the space within the core and coil windows. More specifically, the coil space factor is a measure of the utilization of the space within the core window by the coil, and this factor is maximized when all of the available space within the core window is either conductor or layer insulation. The core space factor is the measure of the utilization of space within the coil window and would be maximized if all of the space in the window is occupied by the core leg and the core insulation.

Since the frequency is established at 60 hertz, the KVA output per parts size of the transformer is maximized when the flux density, current density and space factors are maximized. Conversely, improvement in these factors will enable the physical size of the transformer to be reduced for a given KVA output rating because of better utilization of the magnetic core and coil material.

As indicated above, one way to increase transformer output or achieve the same output at a lower material requirement is to improve the flux density in the magnetic core. In grain oriented steels used in magnetic core laminations, there is minimum hysteresis loss and reluctance when the direction of magnetic flux through it coincides with the direction of grain orientation, that is, with the lengthwise dimension of the strip, and there is a maximum loss and an increase in reluctance when the flux direction is at right angles to this direction of grain orientation. Oriented magnetic steels all saturate at approximately 130 kilolines per square inch in a direction parallel to the grain orientation, and saturate at approximately 90 kilolines per square inch in directions perpendicular to the grain. In a core having laminations of an alternately laid up E and I configuration, one-half of the yoke lamination stack will saturate at 90 kilolines per square inch and the other half will saturate at 130 kilolines per square inch thereby rendering an overall saturation limit of approximately 110 kilolines per square inch. Allowing for a 10% overvoltage, the maximum operating density is approximately 100 kilolines per square inch. In both the E and I configuration and in a butt-lap lay of core the resistance to flux flow at a core corner, where the flux must flow from a lamination piece in a direction parallel to the grain orientation, across a joint or gap and then into an adjoining lamination which is oriented 90° to the first laminations results in a "corner effect" which reduces the overall saturation limit of the joint and produces vibrations resulting in noise. In order to overcome this problem, prior art magnetic cores in oil filled transformers comprise laminations wherein the corner joints are mitered or beveled in order to minimize the cross grain travel of the flux in the corners of the core. However, the magnetic cores in most dry-type transformers have employed butt joints wherein the lines of flux in adjoining laminations flow in direction 90° to the grain orientation around the corners of the core.

As indicated above, a second factor in improving the output of a transformer without increasing its size, or, alternatively, maintaining the same output with a smaller size, is to improve the coil space factor within the core window and the core space factor within the coil window. Typically, the coils are wound around a rectangular mandrel or form, and the conductor is tensioned between the mandrel and conductor supply so that each layer of conductor can be tightly wound on the preceeding layer and duct spacers. After winding, however, when the tension on the conductor is released, springback in the conductor tends to cause the coil to bow outwardly in the side portions thereof thereby producing convex crowning on the exterior surfaces of the coil sides and concave crowning on the interior surfaces thereof, which are immediately adjacent the core.

In a transformer where each core window is occupied by the side portions of one or two adjacent coils, this crowning effect necessitates that the core window be larger than would otherwise be necessary in order to provide sufficient room for the coil or coils. Overbuilding of the core to provide a larger core window results in less than maximum utilization of the core window thereby decreasing the space factor. Typically, prior art dry-type transformers have a coil space factor within the core window of 55% caused by breathing space, overbuilding and the spring back effect discussed above. The springback also causes a slight bowing out of the inner conductor layers as well, thereby providing a slight concave space between the inner conductor layer of the coil and the core leg, thereby resulting in a less than optimum space factor for the core within the coil window.

The third factor which limits the output of a transformer is the current density within the coil. Heat buildup inside the copper or aluminum conductor of a transformer dictates that a short circuit or severe overload such as fifty times normal current for two seconds and/or two times normal current for thirty minutes will cause the conductor to melt. In order to drive the current density as high as possible, it is necessary to conduct heat away from the conductor to the ambient so that the temperature of the conductor will stay within acceptable limits. As the cooling of the conductor within the coil is increased, the current density can be concomitantly increased thereby resulting in an increase in the KVA output of the transformer.

Typical prior art dry type transformers are rectangular in shape with the conductor layers in the side portions in close overlapping relationship and most or all of the conductor layers in the end portions being spaced apart so as to form air ducts therebetween to permit air to flow through the conductor layers thereby conducting heat away from the coil. Although the temperature of the conductor within the coil end portions can be maintained at an acceptably low level quite easily due to the presence of the air ducts, there has been a problem in conducting heat away from the tightly wound layers in the sides of the coil. A portion of the heat is conducted inwardly to the core, which functions as a large heat sink, but the majority of the heat must be transmitted down to the air ducts in the ends of the coil for dissipation into the ambient air surrounding the coil.

In order to space apart the conductor layers in the ends of the coil, duct spacers of various types have been used in the past. Basically, duct spacers are elongate elements made of a material which is not electrically conductive, such as a glass filled high temperature polyester. In oil filled transformers, there are a series of closely spaced duct spacers within each duct, and because the oil surrounding the coil is such an effective conductor of heat, the problem of providing sufficient breathing space within the ducts is not nearly the problem that it is in air cooled dry type transformers wherein maximum exposure of the conductor layers to air is such a high priority. In prior art dry type transformers, the air ducts in the ends of the coil are formed by inserting elongate duct spacers between adjacent conductor layers during winding of the layers, and by locating the duct spacers at the corners of the conductor layers so that as the next layer is wound thereon, it will be bent along the duct spacers to form corners and will be spaced from the preceeding layer by the duct spacers. Although locating the duct spacers at the corners of the coil is useful to space the end conductor layers the entire width of the coil, and to maintain the structural integrity of the coil after winding to prevent collapsing of the coil during further assembly of the transformer and during use, particularly under short circuit conditions, the corner duct spacers act as thermal barriers inhibiting the flow of heat from the sides of the coil to the air ducts in the ends. The heat generated within the tightly wound sides of the coil tends to flow along the conductor layers toward the cooler end portions of the coil and the corner duct spacers act to insulate the corner portions of the conductor layers from the ambient thereby maintaining the corners at relatively high operating temperatures, which impedes the flow of heat from the coil sides past the conductor layer corners. The inability to more efficiently conduct heat away from the transformer coil imposes a constraint on the maximum current density for the coil, thereby, necessitating more conductor to achieve the same amount of flux.

Prior art dry-type transformers have less than optimum flux density, current density and space factors due to the deficiencies outlined above. For example, the flux density in the core is typically in the 90 to 100 kilolines per square inch range, the current density is approximately 1200 amps per square inch, and the coil space factor within the core window is approximately 55%. This gives a utilization of these three factors in prior art transformers which directly translates into requiring a large core, high conductor requirements to achieve the desired current rating and high noise levels due to the larger physical size of the transformer.

SUMMARY OF THE INVENTION

The transformer according to one embodiment of the present invention overcomes the above-discussed deficiencies of prior art dry type transformers and result in a utilization, when considering the factors of flux density, current density and core and coil window utilization, that is 40% to 70% higher than prior art utilization. This is accomplished by utilizing a stacked lamination magnetic core wherein the ends of most of the laminations are mitered so that the flux paths around the corners of the core will be such that cross grain travel is minimized. The particular lamination pattern utilized for the three phase transformer disclosed in the present application is that shown in U.S. Pat. No. 3,212,042 assigned to the assignee of the present application. It has been found that the mitered cores constructed in accordance with the present application saturate at approximately 129 kilolines per square inch, and with a 10% over voltage requirement, this results in an operating density of 115–117 kilolines per square inch. Since the flux density can be driven to a higher limit, the magnetic core can be made smaller and yet accommodate the same amount of total flux which is necessary to produce the desired output. Since the cost of the core material is a very significant factor in the overall cost of the transformer, the reduction in core size relates very directly to a reduction in transformer cost.

There is also a beneficial effect on the current requirements that the coil is required to handle because a smaller core will result in less conductor length and, therefore, less conductor losses, translating to greater efficiency, thereby enabling a given flux level and current level to be maintained at a lower material weight and a higher electrical efficiency. One of the problems of driving a prior art non-mitered core in a dry-type transformer at higher flux density levels is that of noise due to the "corner effects" of the non-mitered joints. This is a much smaller problem in oil filled transformers because the oil tends to dampen the noise from vibrations, whereas in air cooled transformers, the noise is transmitted directly through the undamped enclosure for the transformer. In order to achieve acceptable noise levels in prior art dry-type transformers, it may be necessary to reduce the flux density down to perhaps as low as 100 kilolines per square inch, which will necessitate using a larger core with the concomitant higher losses and material usage.

The second factor affecting the output of the improved transformer according to the present invention is that of the utilization of space within the core window, that is, the coil space factor. As the conductor is wound during the manufacture of the coil forming a part of the present invention, sheets of electrically insulating material are laid on the preceeding conductor layer and then the subsequent conductor layer is wound thereon. The sheets of insulation material, which are inserted between the conductor layers only in the side portions of the coil, are first coated on both sides with B-staged adhesive bonding material which is uncured, or at least, not completely cured. Following winding, the sides of the coil are clamped at high pressure to compress together the conductor layers in each side so that the bonding material is brought into intimate contact with the conductor layers and the conductor layers and insulation are compressed to a tightly packed state thereby reducing the thickness of the coil sides in the area of the coil window. While still under compression, the bonding material is cured, such as by heating it in an oven or utilizing resistance heating, so that when the clamping forces are removed, the bonding material retains the coil side portions in their compressed states.

This compression bonding operation squares up the outer surfaces of the coil sides so that the crowning effect mentioned above is eliminated, and it is then possible to accommodate the sides of the two compressed coils in a smaller core window than is possible with coils that are not so compressed. This results in an improved coil space factor because the core window can be made smaller yet will accommodate the same amount of conductor and insulation both because the coil sides do not bow outwardly to the same extent as an uncompressed coil, and also because there are less air spaces between the conductor and insulation layers. A further advantage to reducing the core window is that the core itself can be made smaller, thereby requiring less magnetic steel, and resulting in a core which will have less losses thereby resulting in more efficient operation. As mentioned previously, because of the smaller core, less conductor will be necessary for the same KVA size transformer.

The compression bonding also squares up the surfaces on the inner sides of the coil so that there is less clearance between them and the legs of the core. This improves the core space factor, and also permits better conduction of heat from the coil sides into the core because the air gap between the coil and core has been reduced. Moreover, since the coil sides are compressed and form a more solid block of conductor and insulation, there is better conduction of heat from the interior of the coil sides inwardly to the core and outwardly to the ambient.

Although compression bonded coils have been used in prior art oil filled transformers, the ability to better conduct heat out of the compressed sides of the coil in a dry type, air cooled transformer is a benefit that is more important to dry transformers than oil filled transformers due to the higher temperature rises that are employed in dry transformers. Dry transformers typically operate at 150° C. rise while oil filled transformers operate at 65° C. rise. Hence, improved thermal conductance radially is most beneficial to dry type transformers. In a dry-type transformer, the air between adjacent conductor layers in the sides of uncompressed coils is not at all effective in conducting heat away from the coil sides, so the compression of the coil to form a solid block of conductor and insulation layers in the coil sides does in fact produce a beneficial result in a dry type transformer that is of less importance in an oil filled transformer.

By compressing and bonding the coils, the reduction in the thickness of the coils to approximately 75% has been achieved. The primary impact on cost reduction is, again, because of the ability to use a core of smaller size because of the smaller core window requirements, and this reduction in size is further enabled by the ability to drive the coil at a higher flux density because of the lamination mitering. Thus, the net result of the compression bonding coupled with the mitered core is the reduction in core size and accompanying reduction in the amount of magnetic steel which is necessary to achieve a particular output rating.

The compressing and bonding of the coils also enables a particular ducting arrangement to be utilized whereby there is more surface area of conductor exposed in the air ducts, and better conduction of heat from the conductor in the coil sides to the end portions can be achieved. As discussed earlier, prior art transformers of this general type typically provided a series of elongate duct spacers at the corners of the coil around which the conductor is wound. Although locating the duct spacers at the corners enables the transformer to be wound in a rectangular shape and enables the conductor layers in the end portions to be spaced along the entire width of the coil, confinement of the conductor in the corners by the duct spacers forms a thermal block which impedes the flow of heat from the tightly wound sides to the air ducts in the end portions of the coil. This impaired cooling of the transformer necessitates a lower current density limit thereby requiring more conductor for a given KVA rating which increases the cost of the coil. The larger coil also necessitates a larger core window and a larger core so that there is an increase in coil material as well.

By eliminating the corner duct spacers and locating only one duct per coil in the center portion of the ducts and away from the corners, the corners of the conductors can be maintained at a lower temperature because they can immediately transmit their heat to the ambient air within the ducts. It has been found that locating a single duct spacer in the center portions of the ducts results in very minimal decrease in breathing of the ducts, yet is sufficient to maintain the structural integrity of the coil, even during short circuit conditions. It is the compression bonding which makes this possible by bonding the conductor layers together so that they cannot shift relative to each other either during subsequent assembly of the transformer or in use. Thus, the location of the duct spacers away from the corners of the coil made possible by the compression bonding permits heat generated within the coil sides to be conducted much more readily to the conductor in the ends of the coil and from there to the convection ambient air flowing through the ducts.

In order to maintain the structural integrity of the coil, it is preferable that the duct spacers be aligned along respective lines intersecting the coil window, and preferably along a line intersecting the axis of the coil.

One method for manufacturing the coil is to place temporary duct spacers at the corners and permanent duct spacers in the center portions of the coil during winding, and then remove the corner duct spacers after winding and compression and leaving only the permanent center conductors in place.

As can be appreciated, the improvements in the flux density, current density and space utilization factors are not simply additive. For example, although compression bonding results in an improvement of space factors and the conduction of heat from the side portions of the coil, it is also the feature which enables the elimination of the corner duct spacers to be feasible. Another example is in the area of audible noise control. The use of mitered joints results in lower audible noise, but it is also the reduction of the physical weight of the core made possible by compression bonding of the coil that enables such good noise reduction, and allows, therefore, flux density to be increased to theoretical limits.

In short, the combination of the mitered core, compression bonding of the coils and the improved ducting achieved by the center duct spacers results in a transformer wherein utilization of the factors of space utilization, flux density and current density approaches 100%, whereas prior art transformers of this type have utilization of these factors in the range of 50% to 60%.

It is an object of the present invention to provide a dry type, air cooled transformer employing a core having mitered joints in combination with a coil wherein the sides are compression bonded to result in better cooling and, therefore, higher current density so that both the coil and core can be made smaller for a given output rating.

It is a further object of the present invention to provide a dry type air cooled transformer and a method for making same wherein the corner duct spacers which are emplaced during winding can be removed after compression bonding of the coils so as to expose the corners of the conductors directly to the ambient air in the cooling ducts.

A still further object of the present invention is to provide a dry type air cooled transformer wherein the coils are compression bonded to square up the inner and outer surfaces thereby achieving higher core and coil space factors and requiring a smaller core window so that the physical size of the core can be reduced.

Another object of the present invention is to provide a dry-type air cooled transformer wherein utilization of the flux density, current density and space factors is nearly maximized.

In one form of the invention, a dry type air cooled transformer is provided wherein the transformer comprises a rectangular magnetic core having a plurality of interleaved lamination layers each comprising a pair of leg portions and a pair of yoke portions connecting the leg portions, the leg and yoke portions being connected end to end and surrounding a core window. Each of the leg and yoke portions comprises a plurality of stacked laminations each having a favored magnetic direction extending lengthwise of the lamination, and wherein at least some of the leg and yoke laminations in each layer have a mitered end in abutment with a mitered end of an adjacent leg or yoke lamination, the abutting mitered ends forming core joints extending at an angle to the favored magnetic directions of the abutting laminations. The transformer further comprises a coil comprising a plurality of superimposed layers of conductor wound about an axis and surrounding a coil window extending through the coil, each of the coil layers being generally rectangular in planes perpendicular the coil axis and bent at four corners spaced around the coil window. The coil includes two end portions in which at least some of the conductor layers are spaced apart from each other in directions outward from the coil axis to form a plurality of cooling ducts extending through the coil in the axial direction, and the coil includes side portions in which the adjacent conductor layers are compressed together in directions perpendicular to the coil axis. The compressed conductor layers in the coil side portions are bonded together, and duct spacers are provided in each of the ducts spaced inwardly toward a center portion of the duct away from the corners of the conductor layers forming the respective ducts so that the ducts are contiguous to the corners of the conductor layers forming the respective ducts. The coil is mounted on one of the core legs such that the core leg extends through the coil window, and the coil is oriented so that one of the compressed side portions is disposed in the core window.

The invention is also applicable, in one form thereof, to transformers employing annular ducting wherein duct spacers may also be provided between certain of the layers in the coil sides.

There is further provided, in another form of the invention, a dry type air cooled transformer having a rectangular core comprising a plurality of interleaved lamination layers each comprising a pair of legs and a pair of yokes connecting the legs, the legs and yokes being connected end to end and surrounding a core window. Each of the legs and yokes comprises a plurality of stacked laminations each having a favored magnetic direction extending lengthwise of the lamination, wherein at least some of the leg and yoke laminations in each layer have a mitered end in abutment with a mitered end of an adjacent leg or yoke lamination, the abutting mitered ends forming core joints extending at an angle to the favored magnetic directions of the abutting laminations. The transformer further comprises a coil having a plurality of superimposed layers of wound conductor wound about an axis and surrounding a coil window, each coil layer being generally rectangular in planes perpendicular to the coil axis and bent at four corners spaced around the coil window. The adjacent conductor layers in the side portions of the coil are separated from each other by layers of sheet-like insulation material. A bonding material on both sides of the insulation layers bonds together the conductor and insulation and exerts tensile forces on the conductor layers to hold the conductor and insulation in the coil sides in a tightly compressed condition. Elongate duct spacers are positioned between at least some of the layers in the end portions of the coil and extend generally parallel to the coil axis for spacing the layers apart to form ducts for the passage of cooling air therethrough, each spacer extending substantially through the respective duct in a generally axial direction and being located in a central portion of the respective duct away from the corners of the conductor layers forming the duct. The coil is mounted on the core with one of the core legs extending through the coil window, and the coil being oriented so that one of the compressed and bonded sides of the coil is disposed within the core window.

Still further, the invention, in another form thereof, provides a dry type air cooled transformer having a rectangular three legged magnetic core comprising a plurality of interleaved lamination layers each comprising three leg pieces in parallel spaced relation and two pairs of yoke pieces connected respectively between opposite ends of the center leg piece and one outer leg piece, there being a core window between each of the outer leg pieces and the center leg piece. Each of the leg and yoke pieces comprises a plurality of stacked laminations each having a favored magnetic direction extending lengthwise of the lamination, and wherein at least some of the leg and yoke pieces in each layer have a mitered end in abutment with a mitered end of an adjacent leg or yoke lamination, the abutting mitered ends forming core joints extending at an angle to the favored magnetic directions of the abutting laminations. Three coils are mounted on the leg pieces of the magnetic core, each coil comprising a plurality of superimposed layers of conductor wound about an axis and surrounding a coil window, each of the coil layers being generally rectangular in planes perpendicular to the coil axis and bent at four corners spaced around the coil window, the coil including two end portions in which at least some of the conductor layers are spaced apart from each other in directions outward from the coil axis to form a plurality of cooling ducts extending through the coil in the axial direction. Each of the coils has opposite side portions wherein the conductor layers are tightly packed together in directions perpendicular to the coil axis, and a bonding material bonds together the compressed conductor layers in the coil and holds the conductor layers in their tightly packed condition. A duct spacer is provided in each of the ducts wherein the spacers are spaced apart from the corners of the conductor layers forming the respective duct to provide air channels in the ducts contiguous to the corners of the conductor layer forming the respective duct. Both bonded side portions of the coil on the center leg of the core are disposed respectively in the core windows and one bonded side of each of the coils on the outer core legs are disposed in their respective core windows.

In another form of the invention, there is provided a method of making a dry-type air cooled transformer comprising forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window. Each of the leg and yoke portions comprise a plurality of stacked laminations each having a favored magnetic direction extending lengthwise of the lamination, at least some of the leg and yoke laminations in each layer having a mitered end placed in abutment with a mitered end of an adjacent leg or yoke portion, the abutting mitered ends forming core joints extending at an angle to the favored magnetic directions of the respective abutting laminations. A coil having a plurality of superimposed layers of wound conductor is formed by winding a conductor around a form and placing duct spacers between at least certain of the conductor layers in end portions of the coil during winding to space the conductor layers apart thereby forming a plurality of air ducts through the coil, the conductor layers being wound in a rectangular configuration having four corners at which the conductor is bent during winding. The duct spacers extend through the duct and are spaced apart from the conductor corners in the respective ducts so as to provide a pair of air channels in each duct contiguous with the respective conductor corners. Side portions of the coil are compressed to compress together the conductor layers and reduce the thickness of the side portions in the area of the core window. While continuing to compress the sides of the coil, the compressed conductor layers are bonded together to retain the coil sides in their compressed state, and the coil is then mounted on a leg portion of the core with one of the compressed sides of the coil being disposed in the core window.

In accordance with another form of the invention, a method is provided for making a dry type air cooled transformer comprising forming a magnetic core by stacking laminations to form a plurality of interleaved lamination layers each comprising a pair of leg portions and a pair of yoke portions connecting the leg portions, the leg and yoke portions being connected end to end and surrounding a core window. Each of the leg and yoke portions comprises a plurality of stacked laminations each having a favored magnetic direction extending lengthwise of the lamination, wherein at least some of the leg and yoke laminations in each layer have a mitered end placed in abutment with a mitered end of an adjacent leg or yoke portion, the abutting mitered end forming a core joint extending at an angle to the favored magnetic directions of the abutting laminations. A coil comprising a plurality of superimposed layers of wound conductor is formed, wherein adjacent conductor layers are separated from each other by respective layers of sheet-like insulation material having a bonding material on both sides thereof. During formation of the coil, duct spacers are inserted between some of the coil layers in an end portion of the coil to space the conductor layers apart in the end portion thereby providing air ducts in the coil extending generally parallel to the layers for the passage of cooling air. The duct spacers extend substantially through the ducts and are located in the center portions thereof so as to provide air channels for the flow of air on both sides of the spacers. At least one side of the coil is clamped to exert compression forces thereon in a direction normal to the coil layers and insulation layers thereby compressing together the coil and insulation layers. While continuing to exert the compression forces, altering the physical properties of the bonding material to bond the adjacent coil layers to the insulation layers therebetween to form a permanently compressed coil side, and then unclamping the coil. Subsequently, with one of the yoke portions not in place on the core, placing the coil on one of the core leg portions while orienting the coil such that the compressed side of the coil is disposed in the core window, and then placing the one yoke portion on the core.

Still further, a method is provided in one form of the invention for making a dry type air cooled transformer comprising forming a magnetic core by stacking a plurality of laminations to form a plurality of interleaved lamination layers each comprising a pair of legs and a pair of yokes connecting the legs, the yoke and legs being connected end to end and surrounding a core window, and wherein each of the legs and yokes comprises a plurality of stacked laminations each having a favored magnetic direction extending lengthwise of the lamination. At least some of the legs and yokes in each layer have a mitered end placed in abutment with a mitered end of an adjacent leg or yoke, the abutting mitered ends forming core joints extending at an angle to the favored magnetic directions of the respective abutting laminations. Forming a rectangular coil comprising a plurality of rectangular superimposed layers of wound conductor surrounding a coil window with adjacent layers at least on one side of the coil separated from each other by layers of insulation including a bonding material thereon and spacing the layers of conductor apart from each other on ends of the coil to form a plurality of air ducts extending generally in the same direction as the coil window, the air ducts being adapted to permit air to pass between the spaced apart conductor layers. The conductor and insulation layers in the coil side in an area overlying the coil window having a thickness dimension in a direction normal to the conductor layers that is larger than ultimately desired because the conductor and insulation layers are not tightly packed during formation of the coil. Temporary duct spacers are placed in the coil ducts at the corners of the rectangular layers during winding of the coil, and a permanent duct spacer is placed in between the temporary spacers during winding. After winding, the temporary spacers are removed thereby leaving the conductor corners directly exposed to their respective ducts. The conductor and insulation layers are compressed together in the coil one side to tightly pack the conductor and insulation layers to reduce the thickness dimension, and while continuing to compress the coil, altering the physical properties of the bonding material to bond together the compressed conductor and insulation layers whereby the bonding material along holds the conductor layers in their compressed state to maintain the reduced thickness dimension. Then the coils are placed on one of the core legs such that the leg enters the core window, and the coil is oriented such that the compressed and bonded side is disposed in the core window.

In yet another form of the invention, there is provided a method for making a dry type air cooled transformer comprising forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the portions comprising a plurality of stacked laminations each having a favored magnetic direction extending lengthwise of the lamination. At least some of the leg and yoke laminations in each layer have a mitered end placed in abutment with a mitered end of an adjacent leg or yoke portion, the abutting mitered ends forming core joints extending at an angle to the favored magnetic directions of the respective abutting laminations. A rectangular coil is wound wherein the coil comprises a plurality of rectangular superimposed layers of wound conductor surrounding a coil window with adjacent layers on at least one side of the coil separated from each other by layers of insulation including a bonding material thereon. Permanent and temporary duct spacers are placed between at least some of the adjacent conductor layers in end portions of the coil during winding of the coil to space apart the layers of conductor in the end portions thereby forming a plurality of air ducts extending generally in the same direction as the coil window, the air ducts adapted to permit air to pass between the spaced apart conductor layers. The conductor layers are bent at about 90° at the sides of the air ducts and the temporary duct spacers are located at the 90° bends in the conductor layers. The permanent duct spacers are located inbetween respective pairs of temporary spacers. The conductor and insulation layers in the coil side in an area overlying the coil window have a thickness dimension in a direction normal to the conductor layers that is larger than ultimately desired because the conductor and insulation layers are not tightly packed during formation of the coil. Subsequently to forming the coil, the conductor and insulation layers are compressed together to tightly pack the conductor and insulation layers and reduce the thickness dimension. While continuing to compress the coil side, altering the physical properties of the bonding material to bond together the compressed conductor and insulation layers whereby the bonding material alone holds the conductor layers in their compressed state to substantially maintain the reduced thickness dimension. The temporary duct spacers are removed at sometime following winding of the coil. Finally, the coil is placed on one of the core legs and oriented such that the compressed and bonded side is disposed in the core window.

BRIEF DESCRIPTION OF THE DRAWINGS

FIG. 25 is an exploded perspective view showing one of the coils and the compression fixture;

FIG. 26 is a perspective view showing compression of the coil;

Figure 1:
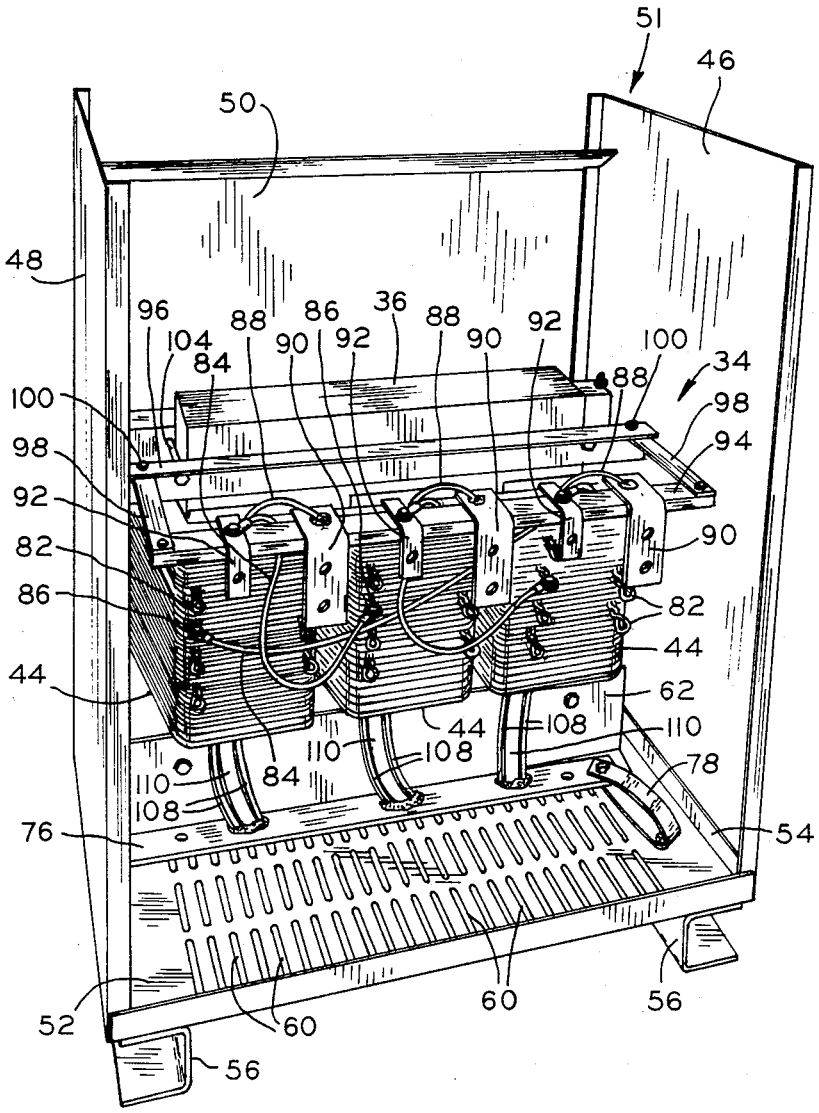
FIG. 1 is a perspective view of a dry type air cooled transformer in one form of the invention mounted within a cabinet.
Figure 2:
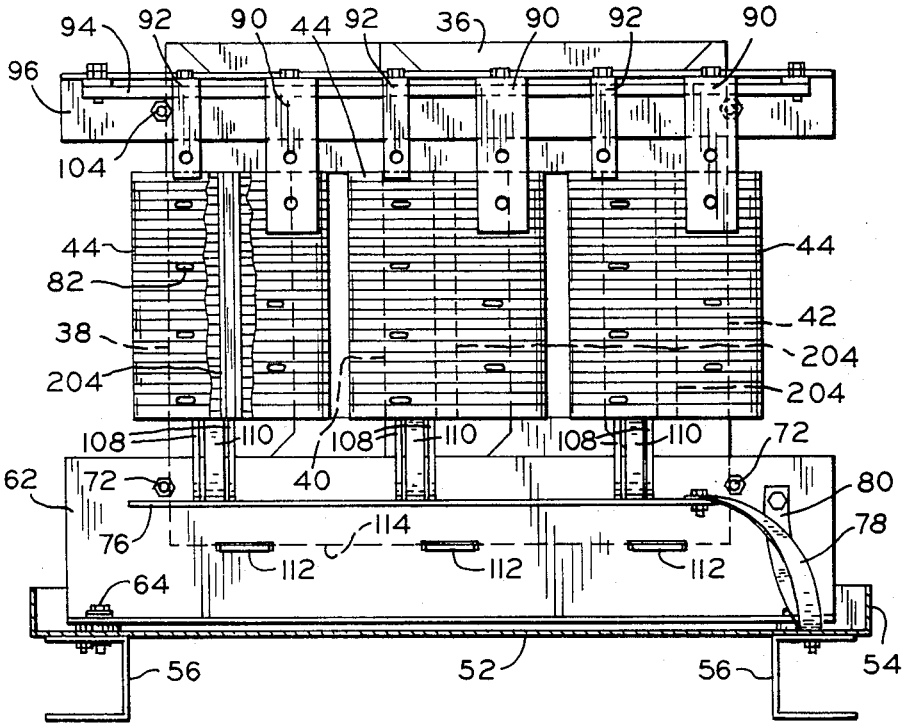
FIG. 2 is a front elevational view of the transformer of FIG. 1 wherein the sides and back of the cabinet have been removed.
Figure 3:
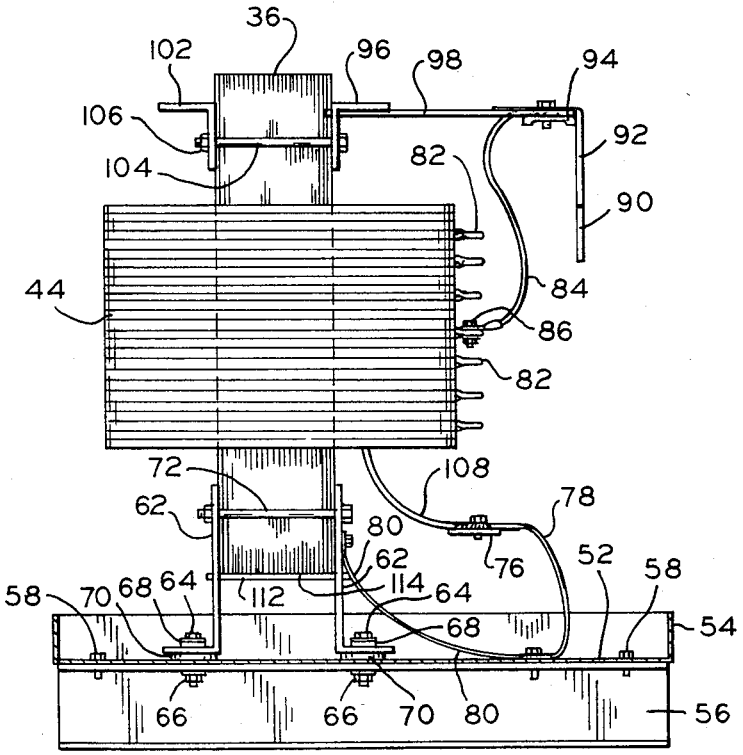
FIG. 3 is a side elevational view of the transformer former of FIG. 2.
Figure 4:
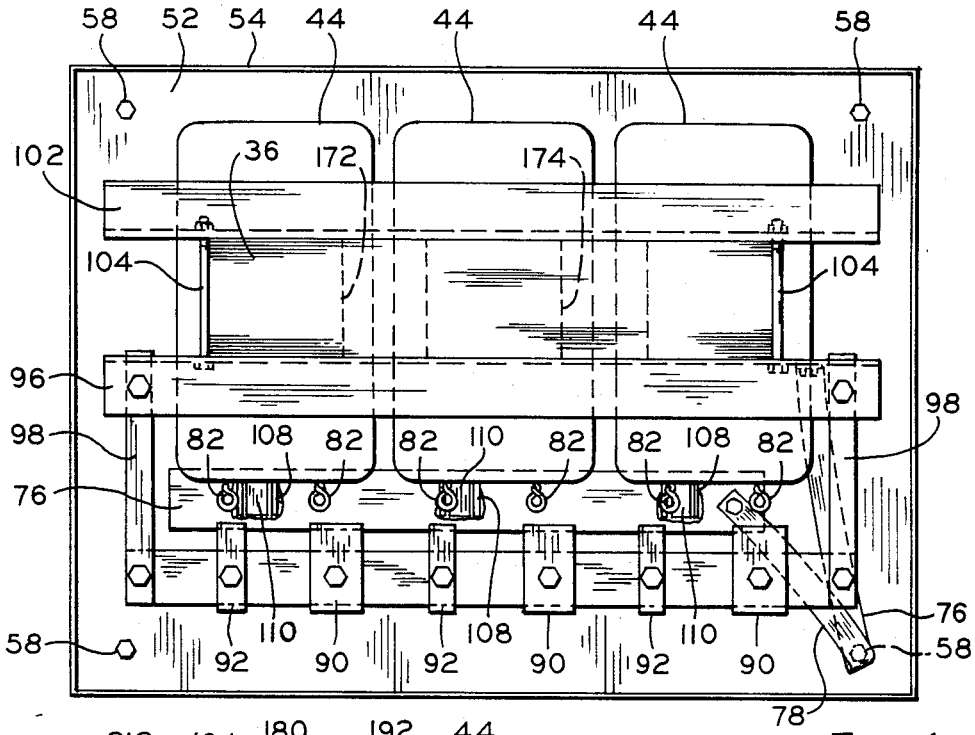
FIG. 4 is a top plan view of the transformer of FIG. 2.

The transformer and method set out herein illustrate an embodiment of the invention in form thereof, but such is not to be construed as limiting the scope of the disclosure of the invention in any manner.

DETAILED DESCRIPTION OF A PREFERRED EMBODIMENT

Referring now to the drawings, and in particular to FIGS. 1-4, a preferred embodiment of the transformer according to one form of the present invention is illustrated. The transformer 34, which is a three phase transformer, comprises a stacked lamination magnetic core 36 having three legs 38, 40, and 42 on which are placed three wound coils 44. Transformer 34 is housed within a cabinet having side panels 46 and 48, a back panel 50 and a base 52. Base 52 comprises side flanges 54 to which the sides 46 and 48 and back 50 are bolted or otherwise secured. A pair of support rails 56 are connected to base 52 by bolts 58 (FIGS. 3 and 4), and serve to raise base 52 off of the surface on which it is supported so that cooling air can flow beneath base 52 and upwardly through openings 60 therein so as to cool transformer 34.

Magnetic core 36 is mounted to base 52 by a pair of L-shaped core clamps 62, that are connected to base 52 and rails 56 by bolts 64, nuts 66, washers 68 and resilient isolation pads 70. Bolts 72 extend through openings in core clamps 62 and clamp core 36 in place. It will be noted that core 36 and coils 44 are mounted in the lower portion of cabinet 51 and in relatively close proximity to base 52 so that transformer 34 is exposed to cooler ambient air than would be the case if it were mounted in the upper portion of the cabinet, as in some prior art transformers. Leads 108 and 110 from coils 44 are connected to bus bar 76, and bus bar 76 is grounded to base 52 by grounding strap 78 and to core clamp 62 by grounding strap 80.

As is customary in prior art dry type transformers, coils 44 are provided with a plurality of taps to the outermost winding so that the transformer 34 can be connected in a number of different configurations in use. Rather than welding terminals directly to the conductor, as is done in many prior art transformers, termination loops 82 may be formed in the conductor for coils 44 as the coils are wound. The termination loops 82 are twisted, the insulation removed and then dipped in solder so that connections to leads 84 can be made directly by a simple nut and bolt assembly 86. A more detailed description of the formation of termination loops 82 will be provided at a later point. Termination loops 82 are located at selected positions on the outermost conductor layer in coils 44 so as to change the ratio of the input and output voltages. Although twisted termination loops 82 have been used in the past on dry type transformers, they have not been used on compression bonded transformers as described in the present application.

Leads 88 are the end portions of the the actual conductors of the high voltage windings. In order to permit the user to make connections to transformer 34 in a convenient manner, three bus bars 90 for the low voltage winding, and three bus bars 92 for the high voltage winding are provided. Bus bars 90 and 92 are mounted to bus bar board 94, which is made of an electrically insulating material, and board 94 is connected to one of the upper core clamps 96 by support bars 98 and bolts 100. Upper core clamp 96 and rear upper core clamp 102 are connected to core 36 by bolts 104 and nuts 106. Core clamps 96 and 102, like lower core clamps 62, compress the laminations in magnetic core 36 as bolts 72 and 104 and their respective nuts are tightened. Conductor ends 88 are connected to bus bars 90, leads 84 from selected termination loops 82 are connected to bus bars 92, the ends 108 of the high voltage winding of coils 44 and conductor ends 110 of the low voltage winding of coils 44 are connected to ground bus bar 76. The user makes connections to bus bars 76, 90 and 92 by means of conventional terminals (not shown). Support bars 112 pass through slots in core clamps 62 and support the lower surface 114 of core 36.

Figure 6:
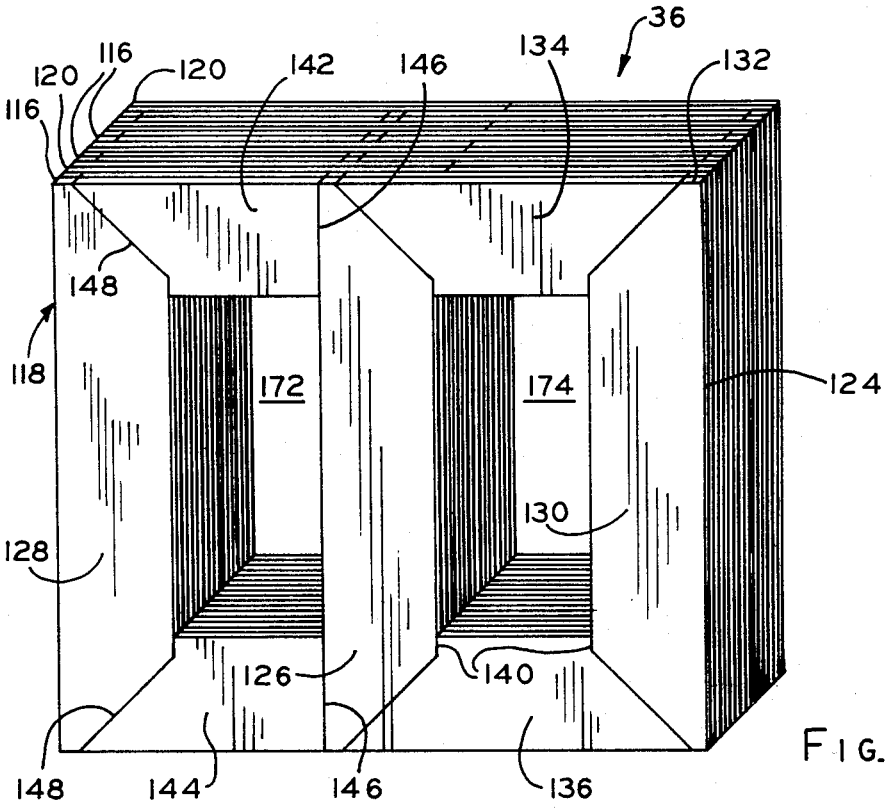
FIG. 6 is a perspective view of the magnetic core of the transformer wherein the front lamination layer is one of the odd numbered set of layers.
Figure 7:
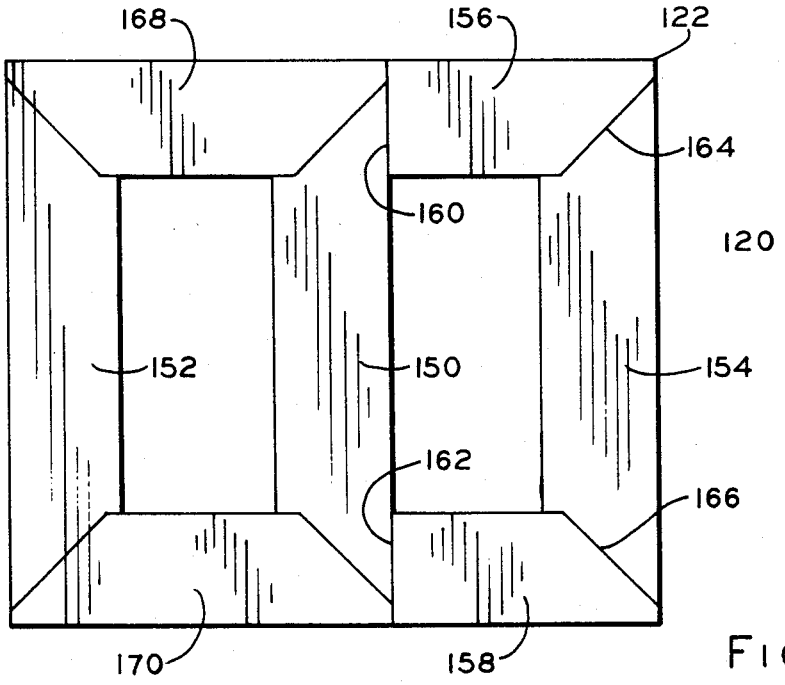
FIG. 7 is a front elevational view of one of the even numbered lamination layers of the magnetic core of FIG. 6.

Referring now to FIGS. 6 and 7, magnetic core 36 will be described. FIG. 6 illustrates a flat stacked laminated magnetic core 36 having a thickness which is determined by the number of lamination layers therein. The lamination layers are divided into a set 116 of odd numbered layers of which the single exposed layer 118 at the front of FIG. 6 is representative, and a set 120 of different even numbered layers of which layer 122 shown in FIG. 7 is representative. All of the layers 116 and 120 are preferrably edgewise coincident in the sense that neither set has projections which protrude beyond the other set, or voids or recesses which do not extend out to the edge of the other set. Each layer comprises a plurality of separate sheets of laminations, and the presently preferred arrangement is four sheets per layer, although FIG. 6 has not been drawn with sufficient lines to show each individual sheet, for purposes of clarity of illustration.

Referring to the front sheet 124 of the odd numbered layers 116, it comprises a center leg piece 126, and two outer leg pieces 128 and 130, which are identical to each other. The ends of leg pieces 126, 128 and 130 are beveled or mitre cut at an angle of 45° to their lengthwise dimension with the end tips or points cut off to produce square corners, such as corner 132 on leg piece 130, for example. Each of leg pieces 126, 128 and 130 are made of conventional grain oriented magnetic steel wherein the grain orientation, which is also known as the favored magnetic direction, is along the longitudinal direction of each lamination. As is well known, magnetic steel of this type presents less reluctance to the magnetic flux in directions parallel to the favored magnetic direction than in directions transverse thereto. Such types of steel are well known so that further discussion of them is not necessary.

Each sheet 124 in the odd numbered layers 116 also comprises two yoke pieces 134 and 136, which are identical and have their ends mitered or bevel cut at an angle of 45° to their lengthwise dimension except that those bevel cuts are square notched on the same side of the piece or part as indicated at corners 140 so that the cuts do not extend in a straight line entirely across the ends of the pieces. Sheet 124 also comprises two yoke pieces 142 and 144, which are identical to each other and have one end 146 which is cut square and the other end 148 which is mitered or bevel cut at 45° to the longitudinal direction of the lamination 142 or 144, which is a direction perpendicular to the longitudinal dimensions of leg pieces 126 and 128. Thus, the major portion of ends 148 is cut at a bevel relative to the favored magnetic direction, and ends 146 are cut perpendicular to this favored magnetic direction. In the case of yoke pieces 134 and 136, the major portions of both ends are beveled at 45° to the favored magnetic direction. As indicated earlier, each of the odd numbered layers 116 comprises four such sheets 124 comprising leg pieces 126, 128 and 130 and yoke pieces 134, 136, 142, and 144.

FIG. 7 illustrates one of the sheets 122 of an odd numbered layer 120 and will be seen to comprise a center leg 150 and a pair of outer legs 152 and 154, all of which are identical to each other. Each of leg pieces 150, 152 and 154 have the major portions of their ends mitered or bevel cut at an angle of 45° to the longitudinal dimension of the lamination, which is also the direction of the grain orientation. Yoke pieces 156 and 158 are identical to each other and have ends 160 and 162, respectively, which are cut perpendicular to the direction of grain orientation, and comprise ends 164 and 166, the major portions of which are cut at an angle of 45° to the direction of grain orientation. Yoke pieces 168 and 170 have their ends cut at beveled angles of 45° to the longitudinal dimension of the laminations 168 and 170, which coincides with the direction of grain orientation. All of the laminations 150, 152, 154, 156, 158, 168 and 170 of each of sheets 122 of the even numbered lamination layers 120 is made of a grain oriented magnetic steel commonly used in transformer manufacture.

In stacking the laminations to form magnetic core 36, the leg and yoke pieces are arranged end to end so that they circumscribe two vacant core windows 172 and 174 which receive the sides of coil 44. As will be described at a later point, upper yoke pieces 142, 168 and 134, 160 can be assembled to legs 128–152, 126–150 and 130–154 after placement of the coils on core 36.

Although a particular pattern of lamination arrangement has been illustrated, the invention is not limited to a magnetic core having this particular structure. In designing core 36, priority is given to obtaining the maximum area of mitered core joints between abutting laminations yet producing as little scrap as possible in stamping out the laminations. Although all of the core laminations are shown to have equal thickness and width, which results from their being cut from the same strip of magnetic material, it would also be possible to have a core whose legs are not equal in width in some applications.

In operation, it will be seen that the core joints across which the magnetic flux flows are, for the most part, beveled so that the flux is not required to travel cross-grain in moving from one lamination to an abutting lamination. Although there are two butt joints in each sheet 124 and 122, and portions of the other joints are along directions perpendicular to one of the laminations, the existence of butt joints has been minimized in a scrapless process for producing the laminations of the core 36. Core 36 is of such a design that the flux density can be driven to approximately 129 kilolines per square inch within acceptable noise levels. By increasing the flux density, the size of core 36 can be reduced yet achieve the same total flux which is necessary for the particular output of the transformer.

Figure 5:
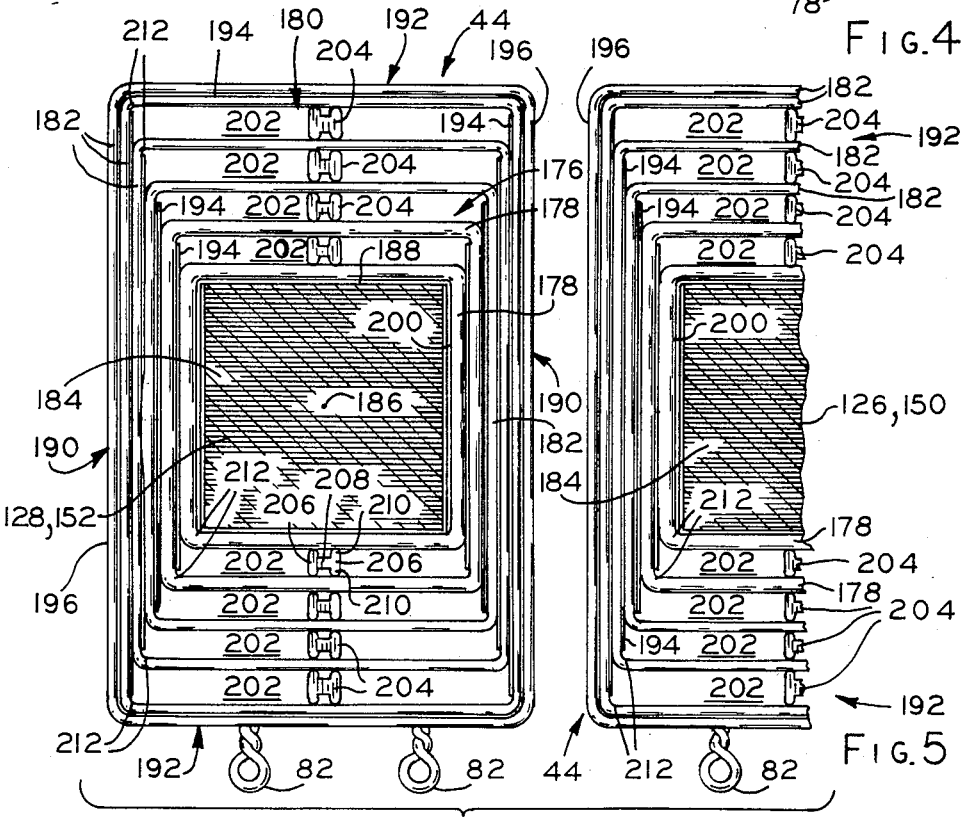
FIG. 5 is an enlarged, top partial sectional view of the transformer.

Referring now to FIG. 5, the structure of coils 44 in the disclosed example will be described. Each of coils 44 comprises a low voltage winding 176 comprising two layers 178 of either aluminum or copper conductor wound in a rectangular shape, and a high voltage winding 180 comprising four conductor layers 182 also wound in rectangular shapes and being made of either copper or aluminum. The conductors forming low voltage and high voltage windings 176 and 180 have ends 88, 110, and 108 which connect to bus bars 90 and 76 as illustrated in FIG. 1. Low voltage winding 176 is specifically made of a conductor having a larger cross sectional area because of its higher current carrying requirements, and the cross sectional shape of the conductor is often rectangular. The invention is not limited to transformers having rectangular conductors, however, but also covers smaller size transformers that utilize round cross section conductors.

Conductor layers 178 and 182 are superimposed on one another about a coil window 184 within which the respective magnetic core leg 128, 152 or 126, 150 is received. The geometrical center of coil window 184 is at the geometrical centers of the respective conductor layers 178 and 182, and this geometrical center is referred to in the present application as the coil axis 186.

Positioned around the core legs 128–152, 126–150 and 130–154 are layers of electrically insulating sheets 188, which have single thicknesses on two sides and double thicknesses on the other two sides. The purpose of insulation 188 is to prevent a short circuit from developing between the innermost conductor layer 178 and core 36. Each coil 44 comprises a pair of opposite side portions 190 and a pair of opposite end portions 192. In side portions 190, conductor layers 178 and 182 are tightly packed together, whereas in end portions 192, the conductor layers 178 and 182 are spaced apart, with the exception of the two outermost layers, which, like the layers in side portions 190, are wound very close together. Inbetween adjacent conductor layers 178, 182 in side portions 190 are positioned one or more sheets of electrically insulating material 194, and a sheet of this material 194 is positioned between the two outermost conductor layers 182 in both the side portions 190 and the end portions 192.

Core insulation 188 and conductor layer insulation 194 in the disclosed embodiment are preferably sheets of aromatic polyamide insulation material, which is available from the E.I. Dupont DeNemours Company under the trademark NOMEX 410. Both sides of the NOMEX paper insulation are coated with an adhesive, such as epoxy, that is B-staged thereon at a thickness of approximately 0.2 to 0.3 mil on each side. B-staged epoxy is epoxy which has been deposited on the NOMEX in a liquid form and the solvents driven off by heat so that the epoxy is left on the NOMEX sheets in a solid form but not completely cured. NOMEX sheets 194 between adjacent conductor layers 178 and 182 are coated on both sides with the epoxy material, but only the sides of the layers of the core insulation 188 which face radially outward are so coated with the epoxy so that the inner sides do not adhere to the clamping fixture during the bonding operation, as will be described below. Insulation sheets 194 extend the full width of the conductor layers on the side portions 190 where there would be any possibility of conductor to conductor contact.

As will be described in greater detail hereinafter, the B-staged adhesive on the NOMEX sheets 194 and 188 is utilized to bond together the conductor layers 178, 182 in the coil side portions 190. The conductor layers 178 and 182 are tightly compressed together so that they and the insulation layers 194 are in a tightly packed condition. When the adhesive is cured by heating, it exerts retentive forces on the conductor layers to maintain them in their compressed state after the clamping forces are removed. The compression and subsequent bonding squares up the outer surfaces 196 of the coil side portions 190 so that the thickness of the coil sides 190 is smaller and the coils 44 occupy less space. This permits smaller core windows 172 and 174 so that core 36 may be made smaller thereby enabling realization of the benefit of the increased flux density benefits obtained by the mitered core design and reducing losses in core 36 so that the amount of magnetic steel and conductor for the same size output transformer can be reduced. Because of the much flatter outer coil surfaces 196, the coil 44 can be moved closer together in core 36 so that more of the space within core windows 172 and 174 is occupied by coil conductor thereby improving the space factor of the coil within the core window. This improvement in space factor produces an increase in output or, alternatively, enables a smaller transformer to be utilized for the same output, in accordance with the formula for transformer output discussed earlier.

Compression bonding of the coil sides 190 also results in an improvement in the core space factor, that is, the utilization of the space within coil window 184 by core 36. Due to springback following winding, the inner surface 200 defined by the innermost conductor layer 178 tends to bow outwardly in the side portions 190 of coil 44, thereby producing a slight air gap between it and the leg of core 36. By squaring up this inner surface 200, the core space factor can be improved, thereby also resulting in an improvement in output characteristics. Compression bonding also assists in the transfer of heat from coil sides 190 to the ambient end to magnetic core 36. In uncompressed coils, there are slight air spaces between adjacent layers and the side portions of the coil, and these air spaces act as thermal barriers to the conduction of heat through the coil sides. By compressing and then bonding the coil sides 190, however, the sides 190 are compressed into a nearly solid block of conductor and insulation, which permits the more efficient conduction of heat both inwardly into core 36, which acts as a heat sink, and directly outwardly through the outermost conductor layer 182 to the ambient. As discussed earlier, an improvement in the ability to cool coils 44 results in an increase in the available current density which can be tolerated, thereby increasing output of the transformer.

The layers of conductors 178 and 182 are spaced apart in end portions 192 of each coil 44 to form a plurality of air ducts 202 therein. Air ducts 202 extend completely through coils 44 in a direction parallel to coil axis 186. As will be noted, the two outermost conductor layers 182 are not spaced apart because adequate cooling can be achieved by virture of the outermost layer being in direct contact with the ambient completely around its periphery. Conductor layers 178 and 182 are spaced apart to form duct 202 by a plurality of duct spacers 204, which are elongate stick-like members extending completely through coils 44 in directions parallel to coil axis 186. Each duct spacer 204, which is permanently retained within coil 44, is made of a high temperature polyester and glass fiber combination, and are generally H-shaped in cross section having a pair of spaced apart legs 206 joined by a connecting segment 208. The ends 210 of each of legs 206, which form elongate ridges, are the only points in contact with adjacent conductor layers 178 or 182 so that maximum exposure of conductor layers 178 and 182 to the ambient air can be achieved.

Duct spacers 204 are preferably located at the centers of ducts 202 and are aligned along respective lines intersecting coil window 184. The alignment of duct spacers 204 is preferred because each spacer 204 supports the next outward spacer 204 against compression forces acting on coil end portions 192, as would be the case under short circuit conditions. Although it is preferred that duct spacers 204 be located at the centers of ducts 202, they could also be located anywhere within the generally central portions of ducts 202 away from the corners 212 of conductor layers 178 and 182. Also preferably, duct spacers 204 are aligned along a single line intersecting coil axis 186, but again, this is not critical to the invention, but only a preferred arrangement.

As discussed earlier, prior art dry type transformers typically have duct spacers located in the corners of the ducts so that the conductor, as it is wound, will be bent around the corner duct spacers thereby forming corners such as corners 212 illustrated in FIG. 5. By permitting the duct spacers to remain at the corner portions, however, thermal barriers are produced at the corners, which maintains the temperature of the conductor at the corners at a much higher level due to the insulating effect of the corner duct spacers. This prevents the conduction of heat along coil sides 190 into the end portions 192, where it can be removed by cooling ambient air flowing through air ducts 202. In accordance with the present invention, however, duct spacers 204 are located inwardly toward the center portions of ducts 202 away from corners 212 so that heat can much more easily flow from coil sides 190, where the temperature is higher due to the compression of conductor layer 178 and 182, to end portions 192 having cooling ducts 202 therein. It has been found that the presence of a single duct spacer 204 in each duct, if located inwardly away from corners 212 has very little effect on preventing heat dissipation. Although a single duct spacer 204 in each duct 202 is preferred, more than one duct spacer could be used, but it is important that the additional spacers also be located inwardly away from the corners 212 of ducts 202.

Insulation layers 194 extend at least to the point where the adjacent conductor layer 178 or 182 nearest coil window 184 is bent so that, when the adhesive cures, there will be some bonding of the layers together, although the bonding will not be effective as in the area of coil window 184 where the compression forces during clamping are the greatest. Insulation layers 194 can terminate directly at the point where the next inner conductor layer 178 or 182 is bent, but may also extend further along the adjacent outer conductor layer 178 or 182 without substantially affecting the cooling of the conductor layers 178 and 182 in ducts 202.

Compression bonding of coils 190 permits the prior art corner duct spacers to be completely eliminated in the final coils 44 because the bonding holds conductor layers 178 and 182 together in their wound shape and prevents one conductor layer 178 or 182 shifting relative to the others in directions parallel and perpendicular to coil axis 186. The function of center duct spacers 204 is to provide stuctural rigidity in directions normal to conductor layers 178 and 182 in coil end portions 192 during subsequent assembly of the transformer 34 and in use, particularly under short circuit conditions. Duct spacers 204 also serve to maintain proper spacing of conductor layers 178 and 182 within the ducted end portions 192.

Of course, the number of conductor layers 178 and 182 and the number of ducts 202 may vary depending on the size and particular design of the transformer 34. Furthermore, while a three phase transformer has been illustrated, the invention is applicable to other than three phase transformers.

With reference now to the remainder of the figures, a method for making transformer 34 in accordance with one form of the invention will be described. Copper or aluminum conductor 216, which may be either round or rectangular in cross section, is wound on a rectangular winding form or mandrel 218, which is rotated in the direction indicated in FIG. 8. Form 218 comprises a pair of end blocks 220, which are also driven in unison with form 218. End blocks 220 have provided therein a pair of center grooves 222 extending from the outer edges 224 substantially inwardly to winding form 218, and also four corner grooves 226, which also extend inwardly from outer edges 224 to form 218, and terminate at form 218 near the respective corners 228 thereof. Center grooves 222 are oriented radially with respect to winding axis 230, and are narrower than grooves 226 for reasons which will be described hereinafter.

Figure 8:
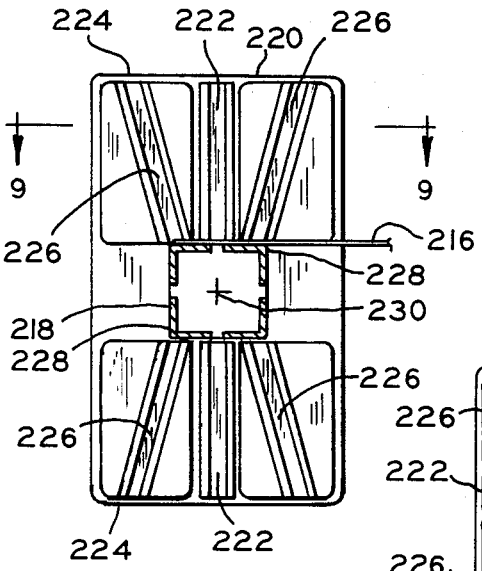
FIG. 8 is a diagrammatic view showing one of the conductors forming the coil being wound on the coil form.
Figure 9:
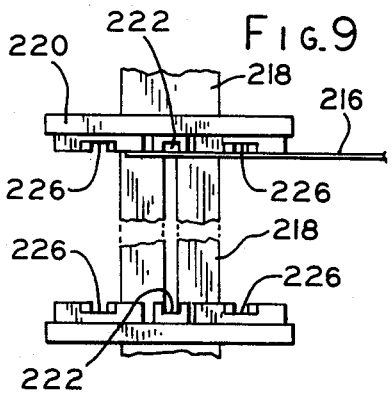
FIG. 9 is a top view showing the winding step of FIG. 8.
Figure 16:
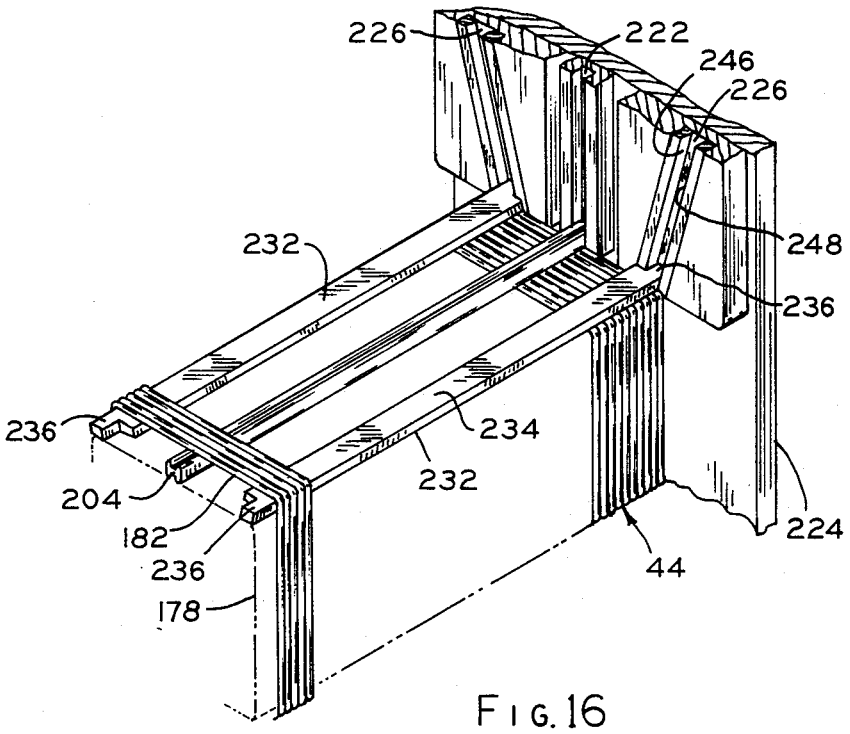
FIG. 16 is a partial perspective view showing the first conductor layer having been wound and the second conductor layer being wound over the first layer and over a set of duct spacers.
Figure 17:
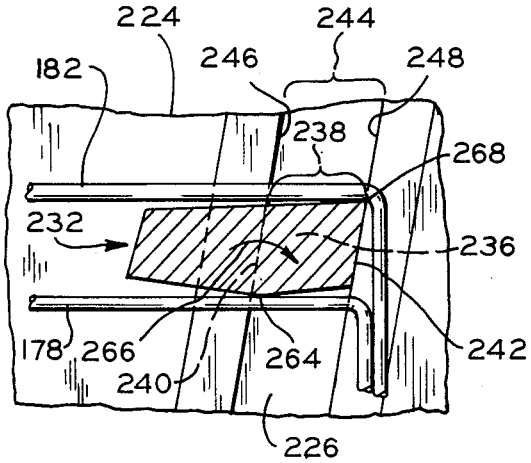
FIG. 17 is a partial sectional view showing one of the temporary, corner duct spacers locked against rotation.
Figure 18:
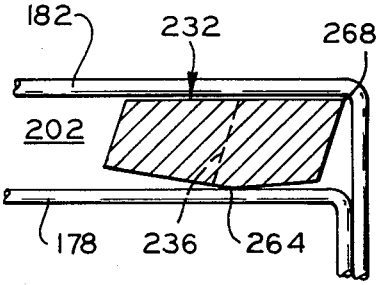
FIG. 18 is a partial sectional view showing the corner duct spacer of 17 after the end blocks of the winding form have been withdrawn.

As illustrated in FIGS. 8 and 9, conductor 216 is started on form 218, which is then rotated in the direction shown under the control of the person operating the winding machine. Once the innermost layer 178 has been wound, a temporary, corner duct spacer 232 is slid inwardly along grooves 226 in each of end blocks 224 into contact with the previously wound conductor layer 178. FIGS. 16, 17 and 18 illustrate the structure of temporary corner spacers 232 and the manner which they are retained in place during winding. Each corner spacer 232 is generally elongate in shape having a shank portion 234 and a pair of notched end portions 236. End portions 236 have a width dimension 238 between parallel sides 240 and 242 which is substantially equal to the distance 244 between sides 246 and 248 of the respective groove 226 so that duct spacer 232 will be locked against rotation about its longitudinal axis when it is slid in place within groove 226.

Figure 10:
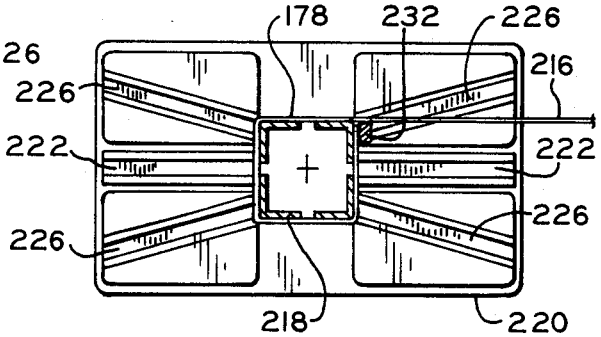
FIG. 10 is a diagrammatic view showing the conductor being wound over one of the temporary, corner duct spacers.
Figure 11:
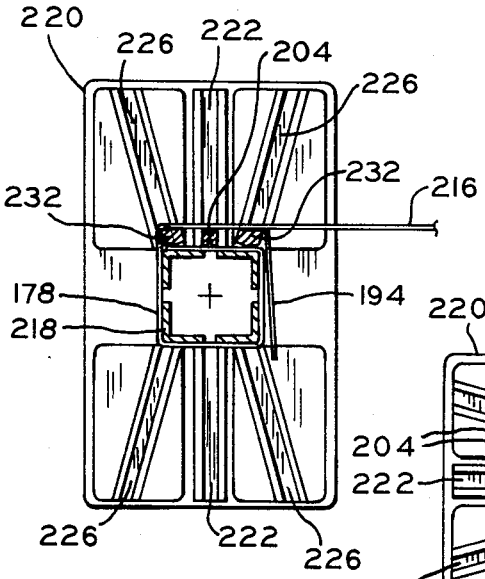
FIG. 11 is a diagrammatic view showing the conductor being wound over two corner duct spacers and one center duct spacer and with an insulation sheet being inserted.

Referring now to FIGS. 10 and 11, form 218 together with its end blocks 224 is rotated slightly further and a permanent, center duct spacer 204 is slid into place along grooves 222, and a further corner duct spacer 232 is slid into place along its respective groove 226. Each of the corner duct spacers 232 is substantially identical to that just described, and are locked against rotation about their longitudinal axis by the capturing of their end portions 236 within grooves 226. As illustrated in FIG. 11, an insulation sheet 194 is then placed against the conductor layer 178 just wound on the side portion 190 of coil 44, and form 18 is further rotated to wind the next conductor layer tightly on insulation layer 194.

In the disclosed example, at some time prior to winding of the coil, the insulation sheets 194, which are made of Dupont NOMEX 410 aromatic polyamide paper, are coated with an epoxy that is B-staged on both sides. The epoxy is a bis-phenol-A epoxy commercially available from the Sterling Chemical Company under the designation Y-663M. The epoxy is coated to a thickness of approximately 0.2 to 0.3 mil, and the solvents are driven off by heat so that the epoxy is left on the NOMEX sheets in a solid form, but not completely cured. It has been found that this epoxy is very compatible with the insulation on the conductor, which may be GEMIDE insulation produced by the General Electric Company, or other insulation materials, such as NOMEX wrap.

Alternative bonding material is a polyamideimide coating which is also B-staged on the NOMEX insulation. With this material, however, bonding is preferably accomplished by resistance heating of the conductor, rather than oven heating, as in the case of the epoxy bonding material.

The present invention is not limited to a particular type of bonding material, and other alternatives may exist.

Figure 12:
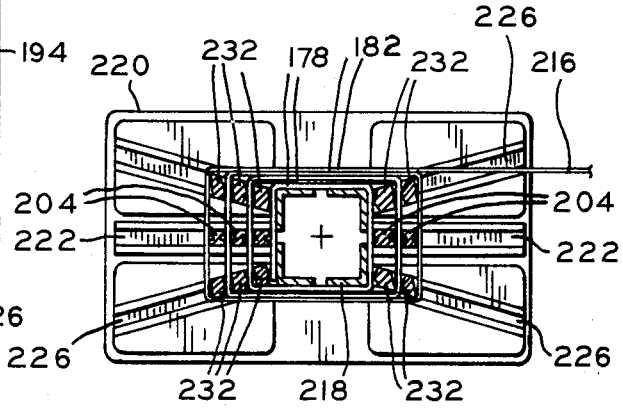
FIG. 12 is a diagrammatic view showing a plurality of conductor layers having been wound on the form and duct spacers.
Figure 13:
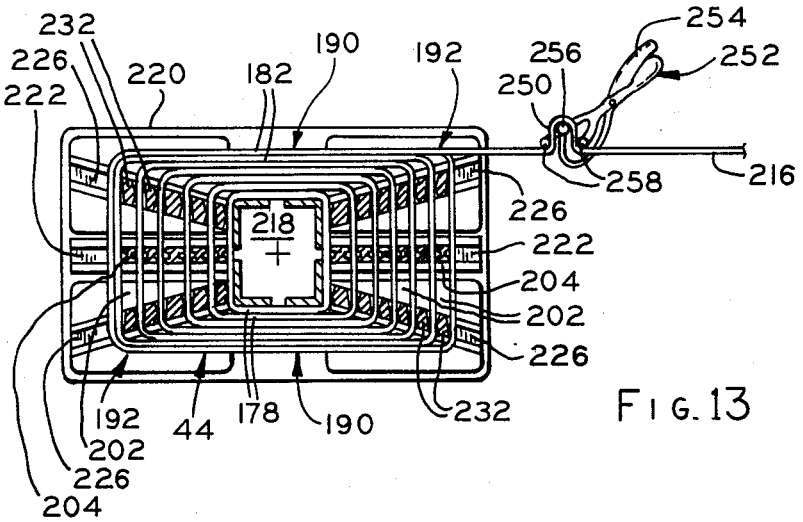
FIG. 13 is a diagrammatic view showing a termination loop being, formed in the conductor prior to its being wound on the coil.

Returning now to FIGS. 11 and 12 of the drawings, once insulation layer 194 has been laid in place, form 218 is further rotated to wind the second conductor layer 178 thereon, two more corner duct spacers 232 are slid into place together with a permanent center duct spacer 204 and the conductor 216 is wound thereon. This operation is repeated as illustrated in FIG. 12, until coil 44 has been nearly completely wound, as illustrated in FIG. 13. Between each of the conductor layers 178 and 182 in coil side portions 190 there is inserted a sheet or sheets of insulation 194, and between all or some of the conductor layers in end portions 192, there are inserted center duct spacers 204 and temporary corner duct spacers 232. As can be appreciated, as conductor 216 is wound over duct spacers 204 and 232, it will be spaced apart in coil end portions 192 so as to form air ducts 202.

Figure 14:
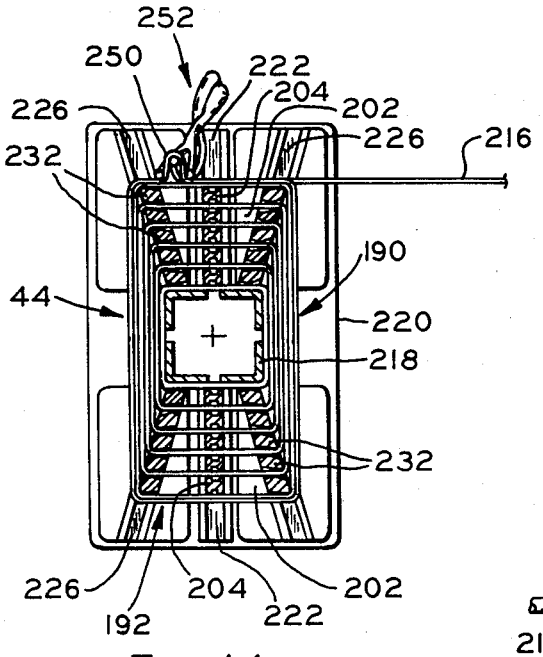
FIG. 14 shows the termination loop being wound on the coil.
Figure 15:
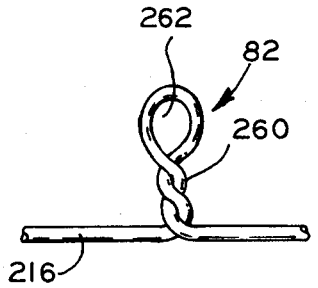
FIG. 15 is a fragmentary view of a portion of the coil showing the twisted termination loop.

FIGS. 13, 14, and 15 illustrate the manner of forming termination loops 82 in coils 44. Since these termination loops are normally formed in the outermost conductor layer 182, the entire coil 144 is wound up to the point of winding the last conductor layer 182 in the forward facing end portion 192 of coil 44. At this point, the rotation of form 218 has stopped and a loop 250 is formed in conductor 216 by means of a suitable tool, such as a hydraulically operated loop former, or the hand operated former 252 shown in FIG. 13. Such tools are only exemplary, however, and loop 250 may be formed by any suitable tool. If using a hand tool such as tool 252, when hand grip portions 254 are squeezed together, peg 256 is pulled in one direction and a loop is pulled between pegs 258. Form 218 is then further rotated to position the loop at the appropriate place on coil 44 as shown in FIG. 14. A plurality of such loops 250 are formed in coil 44, and after the coil is wound, loops 252 are twisted as shown in FIG. 15 to form termination loops 82. The twisted portion 260 of each loop 82 serves to prevent the loop 82 from untwisting and to provide an opening 262 into which can be inserted a bolt 86 or other fastener for the purpose of connecting loop 82 to a lead 84 (FIG. 1).

Referring now to FIGS. 16 through 20, the operation of corner duct spacers 232 during the winding process will be described. Each of the corner duct spacers 232 has a longitudinal fulcrum point 264 which runs along its entire length, at least in the shank portion 234 thereof, so that spacer 232 is capable of rotation about fulcrum 264 in a direction generally indicated by arrow 266 (FIG. 17). Fulcrum point 264 is supported either directly on form 218, as in the case of winding the second innermost conductor layer 178, or on a previously wound layer. Although no insulation is provided between layers of conductor and coil end portions 192, there may be some application of the present invention where insulation layers would be provided, in which case duct spacers 232 would pivot on these insulation layers rather than directly on the conductors themselves.

As discussed previously, notched end portions 236 of duct spacers 232 are locked against rotation by virtue of grooves 226 in end blocks 224 so that the tendency to rotate duct spacer 232 in the direction indicated by arrow 266 as the next succeeding conductor layer 182 is wound thereon is resisted. The next succeeding conductor layer engages duct spacer 232 at corner 268 and exerts a generally inward force thereon, and the spacing between two adjacent conductor layers, such as layers 178 and 182, is determined by the distance between fulcrum point 264 and corner 268 projected in a direction parallel to the previously wound conductor layer 178.

Figure 19:
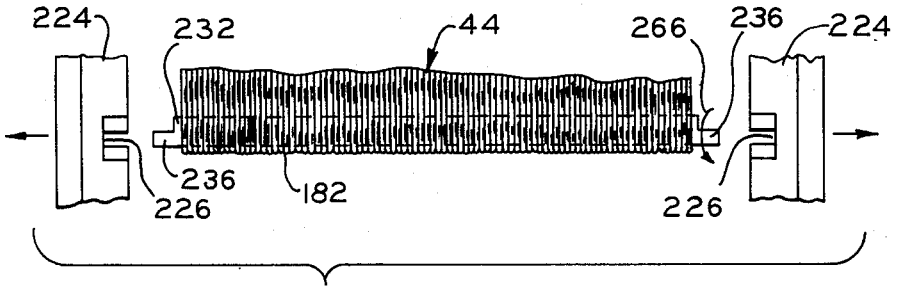
FIG. 19 is a diagrammatic view showing the end blocks of the winding form positioned away from the corner duct spacers.
Figure 20:
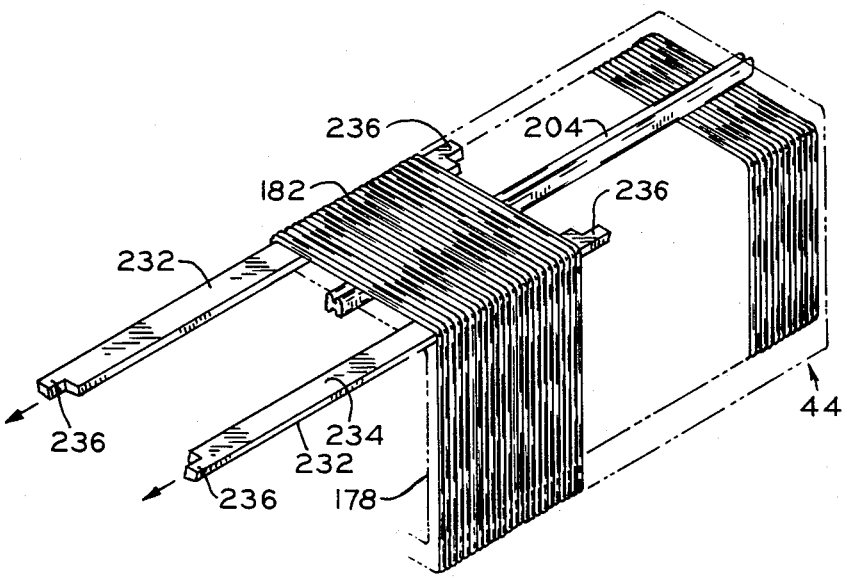
FIG. 20 is a diagrammatic view showing one of the corner duct spacers being removed from the coil.

As succeeding conductor layers 178 and 182 are wound, the spacing between adjacent layers provided by duct spacers 232 is maintained because they are all locked against rotation by grooves 248. Subsequent to winding and the formation of termination loops 82, however, end blocks 224 are moved apart as illustrated in FIG. 19, or one end block 224 is moved relative to the other, so that the notched ends 236 of duct spacers 234 are no longer captured within their respective grooves 226. This permits duct spacers 232 to rotate in the direction of arrow 266 generally to the position shown in FIG. 18 where duct spacers 232 are now loosely received within ducts 202. As coil 44 is slid off form 218, corner duct spacers 232 can easily be slid out of coil 44 as illustrated in FIG. 20, yet the permanent center duct spacers 204 will remain in place due to the tension of winding exerting compressive forces on duct spacers 204.

Although a particular form of corner duct spacers 232 has been illustrated, other arrangements could also be used to enable the corner duct spacers 232 to be removed following winding. For example, duct spacers 232 could be expandable slightly in the dimension of their thickness during winding, and then relaxed or retracted following winding to enable removal. Moreover, even when using the technique of locking duct spacers 232 against rotation and then permitting rotation as described above, the particular diamond shape is not necessary, and other shapes could be used yet still accomplish the same result. To enable coil 44 to be slid off winding form 218, winding form 218 is contracted as in prior art winding machines used for winding the coils of transformers.

Figure 21:
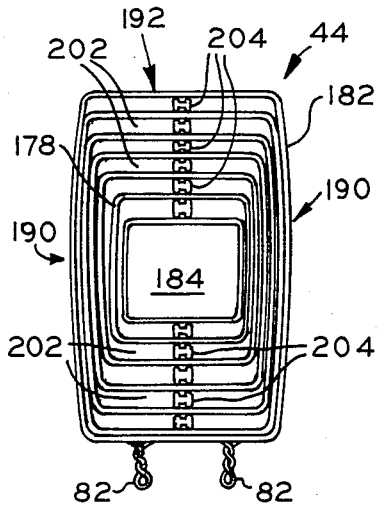
FIG. 21 is a top plan view of one of the coils subsequent to winding and removal of the corner duct spacers.
Figure 22:
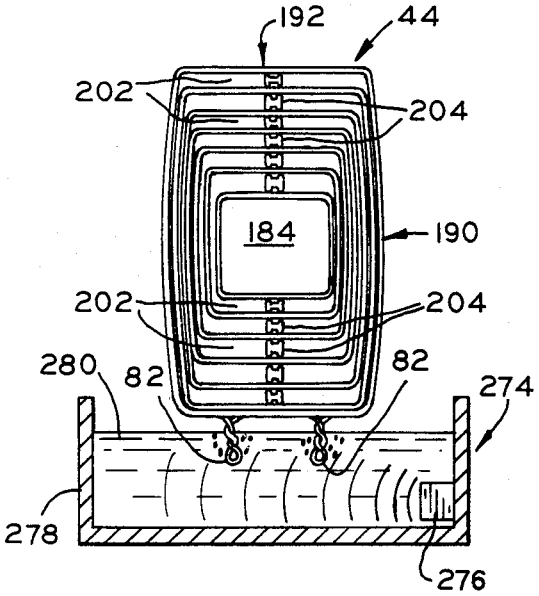
FIG. 22 is a diagrammatic view showing the conductor insulation being removed from the termination loops by an ultrasonic hot salt bath.

FIG. 21 illustrates coil 44 subsequent to winding and removal of corner duct spacers 232. It will be noted that the conductor layers 178 and 182 are rectangular in shape in planes perpendicular to the axis 186 of coil 44, and that air ducts 202 extend completely through coil 44. Although coil 44 is sufficiently tensioned to maintain center duct spacers 204 in place and to retain the shape of the coil 44, springback following the release of the tension which was on conductor 216 during winding will cause side portions 190 of coils 44 to bow outward as illustrated in FIG. 21, thereby increasing the thickness dimension of the side portions 190 in the area of coil window 184.

Before or after termination loops 282 are twisted, they are dipped in a hot salt stripping bath 274 that is agitated by an ultrasonic generator 276. Receptacle 278 holds a hot salt bath 280 having a composition which is 20% sodium hydroxide (NaOH) and 80% potassium nitrate ($KNO_3$), which is operating at a temperature of 400° Celsius. The liquid 280 is agitated by an ultrasonic generator 276, which speeds the stripping action of the hot salt. The hot salt removes the wire insulation on the aluminum conductor, and has proven to be an effective wire insulation stripper on esterimide, amideimide and LO imide. The advantages of the salt stripping is that no additional mechanical stripping is needed, and there is no significant attack on the magnet wire substrate. Furthermore, the reaction gases formed are non-toxic and non-corrosive. The reaction takes place with only water vapor being given off as a byproduct, and the bath decomposes into non-degrading nitrates, nitrites, carbonates and bicarbonates.

One major problem with the burning of insulation off wire is that of the time necessary to accomplish the stripping. A major advantage of using the ultrasonic agitation with a fused salt bath is the decrease in the stripping time due to the ultrasonic cavitation in the molten salt creating a scrubbing action. This mechanical motion helps to remove the magnet wire insulation residues, because instead of simply permitting the salt to float away, the residues are mechanically removed. The second beneficial affect is the reactivity of the salt itself. The byproducts form on the insulation surface and act as contaminants, but the formation of water vapor, potassium nitrite and sodium bicarbonate as byproducts change the reaction site composition and act to retard the removal rate. Rapid and continuous elimination allows the base material to be wetted with the fused salt. The expected benefits of this process is less damage to the coil because of long heat exposure, faster stripping on the large magnet wire giving better utilization of equipment and possible stripping on copper substrates because of the faster reaction times thereby making copper oxidation less of a problem.

Figure 23:
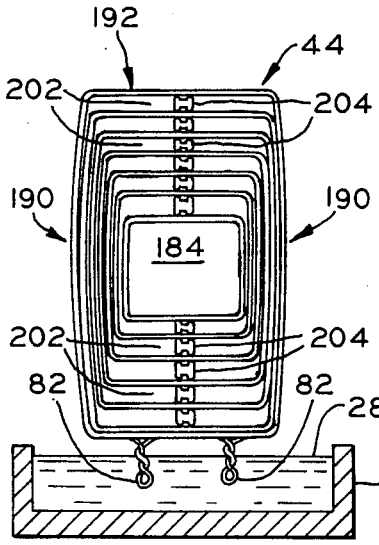
FIG. 23 is a diagrammatic view showing the termination loops of the coil of FIG. 21 being dipped in a solder bath following removal of the insulation.

Following stripping of the wire insulation, termination loops 82 are dipped into a bath 282 of molten solder to prevent oxidation of the wire substrate and to provide a good electrical connection with the leads (FIG. 23).

Figure 24:
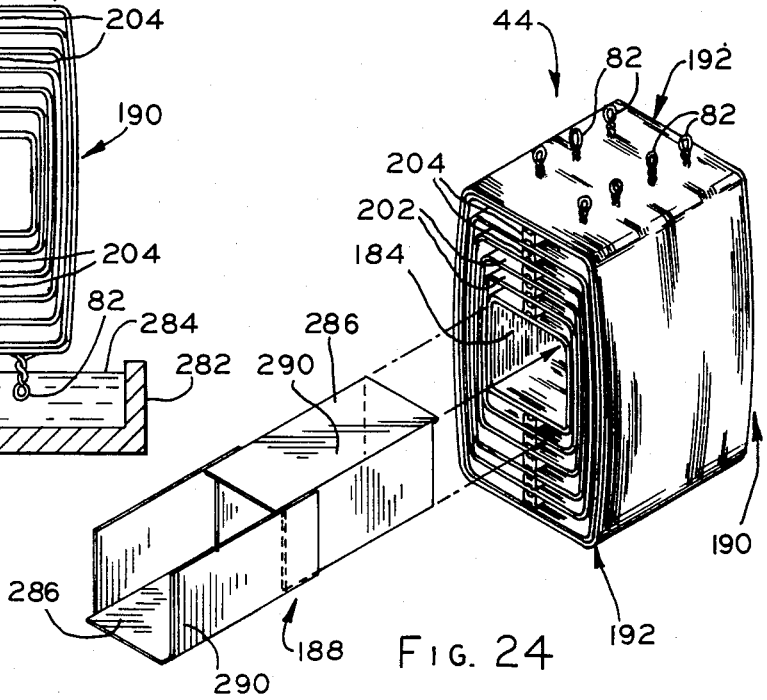
FIG. 24 is a perspective view showing the core insulation being inserted into the coil window.

With reference to FIG. 24, the next step in the manufacturing process is to insert core insulation 188. The core insulation is preferably two sheets of NOMEX insulation 286 one of which is coated on its outer surfaces with the B staged epoxy or other bonding material described above in connection with the conductor insulation layers 194.

Core insulation sheets 286 are bent in U-shapes as shown in FIG. 24 and are inserted in cores 44 prior to compression bonding. A feasible alternative is to use two uncoated channels and insert them when the coils are placed on the core 36. NOMEX insulation may be wrapped around the end turns 192 in order to prevent electrical breakdowns over the edges of channels 286, and duct spacers (not shown) may be inserted between core 36 and end portions 192 of coils 44, if necessary to obtain clearance between core 36 and coil 44.

FIGS. 25 and 26 illustrate the clamping fixture 292 for compressing coil sides 190 prior to the bonding step. Fixture 292 comprises a pair of tapered form elements 294 having end bars 296 connected thereto. Form elements 294 are substantially the same length as the height of coil 44, so that when they are placed in overlapping arrangement within coil window 184, end bars 296 will abut against the top and bottom of coil 44. The thickness of the assembled form elements 294 is approximately equal to the width of coil window 184.

Once form elements 294 have been inserted into coil window 194, plates 298 are placed over the ends of end bars 296 so that bars 296 enter slots 300 in plates 298. Then, tie rods 302 are inserted into notches 304 in plate 298 and locked into place by tightening nuts 306 thereon to form the assembled clamping fixture 292 shown in FIG. 26.

Coil 44 and fixture 292 are placed in a hydraulic press 308 having bolster 310 and ram 312. Ram 312 engages top plate 292 at substantially the center of coil window 184, and a pad or block 314 on bolster 310 engages lower plate 298, again in the area of coil window 184. Preferably, plates 298 are wider than coil window 184 so that there is some compression of conductor layers 178 and 182 in areas beyond coil window 184. Hydraulic press 308 is then activated and coil sides 190 are clamped and compressed between tapered form elements 294 within coil window 184 and end plate 298 at a pressure of approximately 500 pounds per square inch. Because end bars 296 are slidable within slots 300, end plates 298 can move inwardly so as to compress the conductor layers and insulation layers in coil sides 190. This reduces the thickness dimension of coil sides 190 and tightly packs and compresses the conductor layers 178, 182 and insulation layers 194 together. When proper compression has been reached, nuts 306 are tightened down to take up the clearance between them and end plates 298, and fixture 292 and compressed coil 44 are removed from press 308. By compressing coil 44, its overall thickness can be reduced to approximately 75% of what it was prior to compression.

Figure 27:
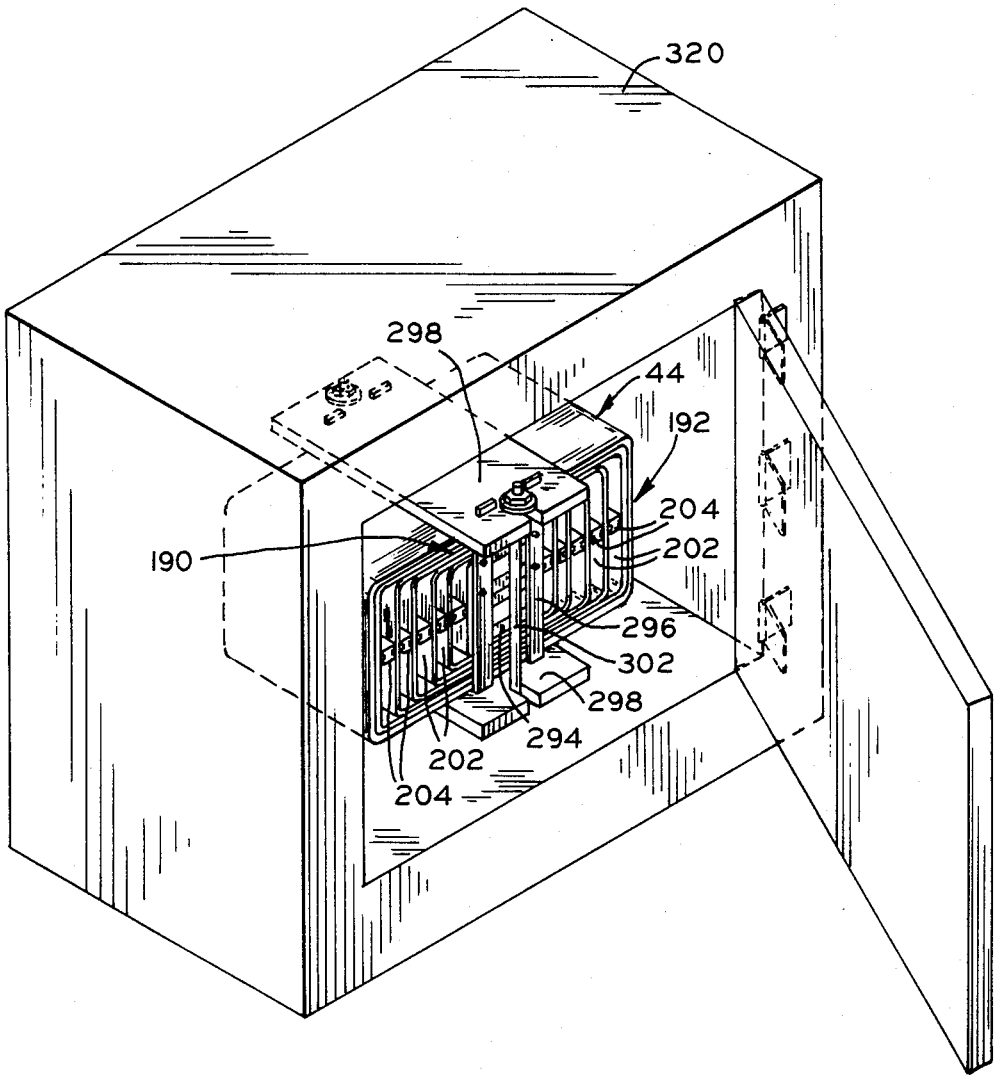
FIG. 27 is a diagrammatic view showing one of the compressed coils being heated in an oven.

Then, fixture 298 and compressed coil 44 is placed in an oven 320 illustrated diagrammatically in FIG. 27. Coil 44 is heated at a temperature of approximately 160° C. for approximately thirty minutes to cure the epoxy bonding material thereby permanently bonding the compressed conductor and insulation layers together. During heating, the adhesive, such as epoxy, first goes through a liquid stage so that it can make intimate contact with the conductor layers, and during subsequent heating cures to a final, solid state. As it cures, it bonds the NOMEX insulation 194 and conductor layers 178, 182 together. Alternatively, if a polyamide-imide coating is utilized, resistance heating of the coils to obtain temperatures of 220° Celsius to 240° Celsius in approximately sixty seconds drives off the remaining solvents and bonds the material. Fixture 292 is then removed from coil 44.

Figure 28:
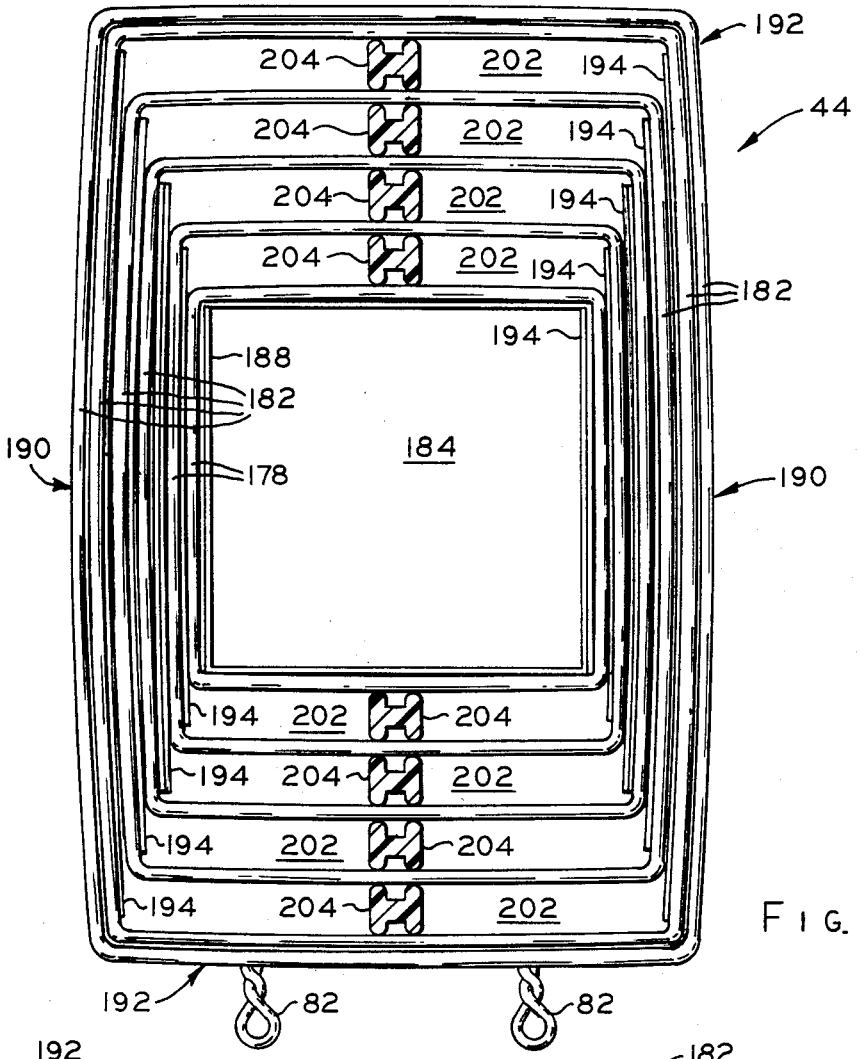
FIG. 28 is an enlarged top view of one of the coils prior to compression bonding.
Figure 29:
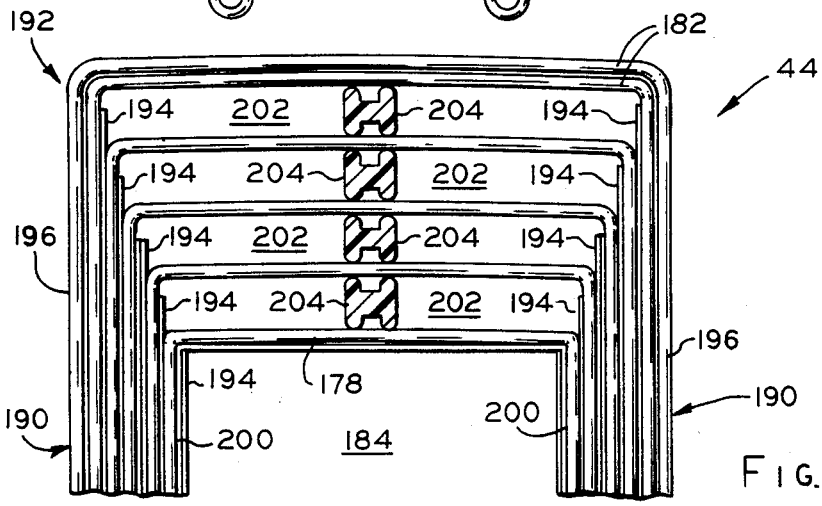
FIG. 29 is a partial top view of the coil of FIG. 28 subsequent to compression bonding.

FIGS. 28 and 29 illustrate diagrammatically the changes that occur in each of the coils 44 by virtue of the compression bonding process. As is illustrated, there is a slight spacing between adjacent conductor layers 178, 182 and the insulation layers 194 so that the side portions 190 of coil 44 are in a relatively loosely wound state, although sufficiently tight to enable coil 44 to hold its shape. This is caused by springback of coil 44 following winding, and causes side portions 190 to bow outwardly, and the innermost conductor layer 178 to be slightly concave in a direction facing coil window 184, also due to a bowing out effect.

FIG. 29 illustrates coil 44 subsequent to compression bonding wherein it can be seen that all of the conductor layers 178, 182 and insulation layers 194 in side portions 190 are in a tightly packed, compressed state so that the outer surfaces 196 of coil side portions 190 are essentially flat and squared off, and inner surfaces 200 of the innermost conductor layer 178 are also essentially flat thereby taking up substantially all of the clearance between it and core 36.

Figure 30:
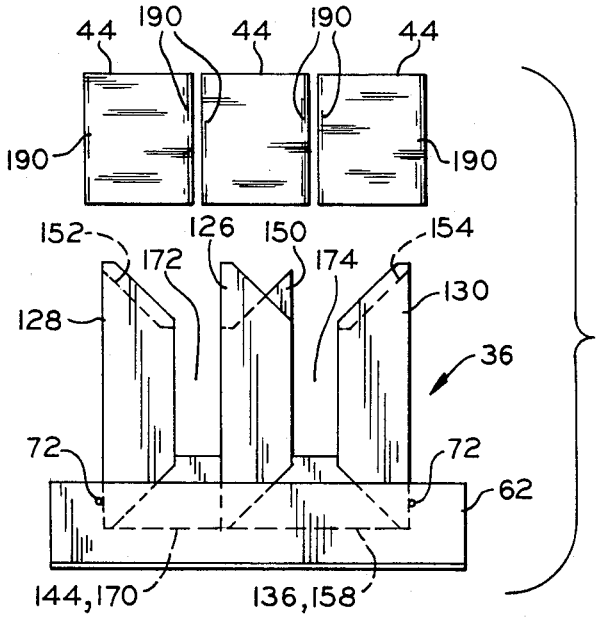
FIG. 30 is a diagrammatic view showing three coils being placed on the three legs of the magnetic core.
Figure 31:
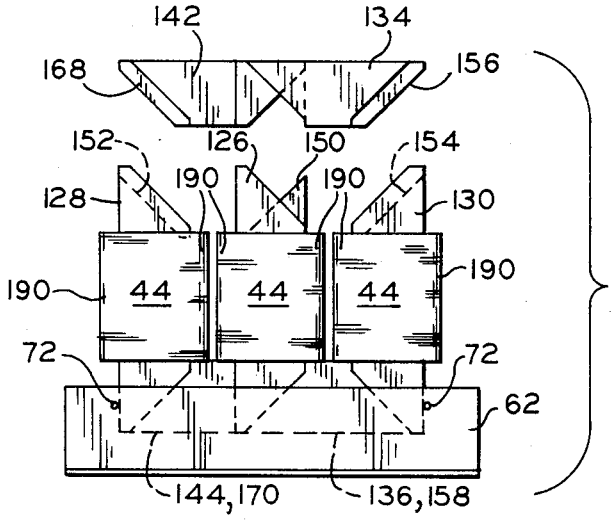
FIG. 31 is a diagrammatic view showing the top yoke pieces of the core being assembled to the leg pieces.
Figure 32:
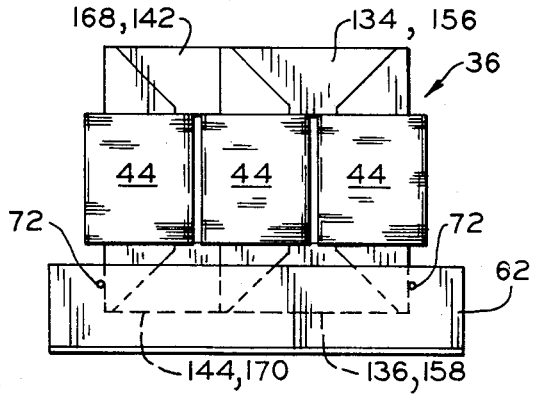
FIG. 32 is a diagrammatic view showing the completed coil and core assembly.

After the bonding step, coils 44 are assembled to partially completed core 36 as illustrated in FIGS. 30–32. Core 36 at this stage of the assembly process comprises three legs 39, 40 and 42, and the two lower yoke pieces 144, 170 and 136, 158. Compressed and bonded coils 144 having core insulation 188 therein are placed over the core legs such that the legs enter the respective coil windows 184, and the compressed and bonded coil side portions 190 are disposed within core windows 172 and 174 as shown in FIG. 31. Then, upper yoke pieces 168, 142 and 134, 156 are stacked in place, and upper core clamps 96 and 102 (FIG. 3) are mounted in place and tightened so as to clamp core 36. Assembled transformer 34 may then be mounted to base 52.

In view of the foregoing, it is apparent that a novel transformer 34 and method of making the same have been described meeting at least some of the objects and advantages set out herein, as well as others. It is contemplated that changes as to the precise arrangements, shapes, details and connections of the component parts of such transformer, as well as the precise steps and order thereof of such methods, may be made by those having ordinary skill in the art without departing from the spirit of the invention or the scope thereof as set out by the claims which follow.

What we claim as new and desire to secure by Letters Patent of the United States is:

1. The method of making a dry type air cooled transformer comprising the steps of:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, forming a coil comprising a plurality of superimposed layers of wound conductor by winding a conductor about a form and placing duct spacers between at least certain of the conductor layers in end portions of the coil during winding to space the certain layers apart thereby forming a plurality of air ducts through the coil end portions, each conductor layer being wound in a rectangular configuration having four corners at which the conductor is bent during winding, the duct spacers extending through the ducts and being spaced apart from the conductor corners in the respective ducts to provide a pair of air channels in each duct contiguous with the respective conductor corners, compressing side portions of the coil not having duct spacers therein to compress together the conductor layers therein and reducing the thickness of the side portions in the area of the coil window, while continuing to compress the side portions, bonding the compressed conductor layers together to retain the coil sides in their compressed states, and then mounting the coil on a leg portion of the core with one of the coil compressed sides being disposed in the core window.

2. The method of claim 1 wherein the coil side portions are compressed by clamping the coil sides, and the step of bonding comprises heating the conductor and a bonding material on the conductor layers in the side portions of the coil while clamping the coil sides.

3. The method of claim 1 including the step of forming a plurality of termination loops in the conductor during winding of the coil such that the loops project outwardly from the outermost coil layer so that the termination loops can be connected to a circuit external of the transformer.

4. The method of claim 3 including the step of twisting the termination loops to form a spiral twisted portion on each loop adapted to prevent the loops from straightening out.

5. The method of claim 3 wherein each loop is formed in a segment of the conductor prior to that segment being wound onto the coil.

6. The method of claim 3 including the step of dipping the termination loops in a hot salt bath agitated by ultrasonic radiation.

7. The method of claim 6 wherein the hot salt bath comprises a composition of 20% sodium hydroxide and 80% potassium nitrate.

8. The method of claim 1 wherein the step of compressing comprises inserting a form element in the core window and exerting clamping forces against the sides of the coil on opposite sides of the coil window against the form element to compact the conductor layers in the coil sides.

9. The method of claim 8 including the step of inserting insulation sheets between the conductor layers and the coil sides during winding, the insulation sheets having uncured bonding material on both sides thereof, and wherein the step of bonding comprises curing the bonding material while compressing the coil.

10. The method of making a dry type air cooled transformer comprising:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, forming a rectangular coil comprising a plurality of superimposed layers of wound conductor surrounding a coil window with adjacent conductor layers separated from each other by respective layers of sheet-like insulation material having a bonding material on both sides thereof forming side portions, inserting duct spacers between at least some of the coil layers in an end portion of the coil during formation of the coil to space apart the conductor layers in the end portion thereby providing air ducts in the coil end portion extending generally parallel to the layers for the passage of cooling air, the duct spacers extending substantially through the ducts and being located in the center portions of the ducts spaced from corners formed by the side portions and the end portion to provide two channels for the flow of air on both sides of the spacers, said channels in each duct being contiguous to respective coil corners, clamping at least one side of the coil to exert compression forces thereon in a direction normal to the coil layers and insulation layers in a side portion of the coil thereby compressing together the coil insulation layers in the coil side portion, while continuing to exert the compression forces, altering the physical properties of the bonding material to bond the adjacent coil layers to the insulation layers therebetween to form a permanently compressed coil side, unclamping the coil, and then with one of the yoke portions not in place on the core, placing the coil on one of the core leg portions, orienting the coil such that the compressed side of the coil is disposed in the core window, and placing the one yoke portion on the core.

11. A method of making a dry type air cooled transformer comprising:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, forming a rectangular coil comprising a plurality of rectangular superimposed layers of wound conductor surrounding a coil window with adjacent layers on at least one side of the coil separated from each other by layers of insulation including a bonding material thereon, spacing the layers of conductor apart from each other on ends of the coil to form a plurality of air ducts extending generally in the same direction as the coil window, the ducts being adapted to permit air to pass between the spaced apart conductor layers, the conductor layers being spaced apart by placing temporary duct spacers in the coil ducts at the corners of the rectangular layers during winding and placing a permanent duct spacer inbetween the temporary spacers during winding, the conductor and insulation layers in said coil one side in an area overlying the coil window having a thickness dimension in a direction normal to the conductor layers that is larger than ultimately desirable because the conductor and insulation layers are not tightly packed during formation of the coil, after winding, removing the temporary spacers to leave the conductor corners directly exposed to the respective ducts, then compressing together the conductor and insulation layers in said coil one side to tightly pack the conductor and insulation layers and reduce said thickness dimension, while continuing to compress the coil one side, altering the physical properties of the bonding material to bond together the compressed conductor and insulation layers whereby the bonding material alone holds the conductor layers in the coil one side in their compressed state to substantially maintain the reduced thickness dimension, then placing the coil on one of the core leg portions such that the one leg portion enters the coil window, the coil being oriented such that the compressed and bonded side is disposed on the core window.

12. The method of claim 11 wherein the insulation layers are sheets of insulation having the bonding material coated on opposite sides thereof, and the step of bonding comprises applying heat to the conductor layers and bonding material at least in the side portions of the coils.

13. The method of making a dry type air cooled transformer comprising:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, winding a rectangular coil comprising a plurality of rectangular superimposed layers of wound conductor surrounding a coil window with adjacent layers on at least one side of the coil separated from each other by layers of insulation including a bonding material thereon, the conductor and insulation layers in said coil one side in an area overlying the coil window having a thickness dimension in a direction normal to the conductor layers that is larger than ultimately desirable because the conductor and insulation layers are not tightly packed during formation of the coil, placing permanent and temporary duct spacers between at least some of the adjacent conductor layers in end portions of the coil during winding of the coil to space apart the layers of conductor in the end portions thereby forming a plurality of air ducts extending generally in the same direction as the coil window, the air ducts adapted to permit air to pass between the spaced apart conductor layers, the conductor layers being bent at about 90° at the sides of the air ducts, the temporary duct spacers being located at the 90° bends in the conductor layers and the permanent duct spacers being located inbetween respective pairs of temporary spacers, compressing together the conductor and insulation layers in said coil one side to tightly pack the conductor and insulation layers and reduce said thickness dimension, while continuing to compress the coil one side, altering the physical properties of the bonding material to bond together the compressed conductor and insulation layers whereby the bonding material alone holds the conductor layers in the coil one side in their compressed state to substantially maintain the reduced thickness dimension, removing the temporary duct spacers at some time following winding of the coil, and then placing the coil on one of the core leg portions such that the one leg portion enters the coil window, the coil being oriented such that the compressed and bonded side is disposed in the core window.

14. The method of making a dry type air cooled transformer comprising:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, forming a coil comprising a plurality of superimposed layers of wound conductor surrounding a coil window with adjacent conductor layers separated from each other by respective layers of sheet-like insulation material having a bonding material on both sides thereof, inserting duct spacers between at least some of the coil layers in an end portion of the coil during formation of the coil to space apart the conductor layers in the end portion thereby providing air ducts in the coil end portion extending generally parallel to the layers for the passage of cooling air, the duct spacers extending substantially through the ducts and being located in the center portions of the ducts and having channels for the flow of air on both sides of the spacers, clamping at least one side of the coil to exert compression forces thereon in a direction normal to the coil layers and insulation layers in the coil one side thereby compressing together the coil insulation layers in the coil one side, while continuing to exert the compression forces, altering the physical properties of the bonding material to bond the adjacent coil layers to the insulation layers therebetween to form a permanently compressed coil side, unclamping the coil, and then with one of the yoke portions not in place on the core, placing the coil on one of the core leg portions, orienting the coil such that the compressed side of the coil is disposed in the core window, and placing the one yoke portion on the core, the step of forming the coil comprising winding the conductor on a rectangular form so that the conductor is bent at four corners during winding to form the conductor layers in rectangular shapes in planes perpendicular to an axis of winding, and including the step of placing temporary duct spacers at the corners of the conductor in the ducts during winding, and then removing the temporary duct spacers after winding.

15. The method of making a dry type air cooled transformer comprising:

forming a magnetic core by stacking a plurality of laminations to form a plurality of interleaved lamination layers each comprising a pair of leg portions and a pair of yoke portions connecting the leg portions, the yoke and leg portions being connected end to end and surrounding a core window, each of the leg and yoke portions comprising a plurality of stacked said laminations each having a favored magnetic direction extending lengthwise of the lamination, at least some of the leg and yoke laminations in each layer having a mitered end placed in abutment with a mitered end of an adjacent leg by a yoke portion, the abutting mitered ends forming core joints extending at an angle to the favored magnetic directions of the respective abutting laminations, forming a coil comprising a plurality of superimposed layers of wound conductor surrounding a coil window with adjacent conductor layers separated from each other by respective layers of sheet-like insulation material having a bonding material on both sides thereof, inserting duct spacers between at least some of the coil layers in an end portion of the coil during formation of the coil to space apart the conductor layers in the end portion thereby providing air ducts in the coil end portion extending generally parallel to the layers for the passage of cooling air, the duct spacers extending substantially through the ducts and being located in the center portions of the ducts and having channels for the flow of air on both sides of the spacers, clamping at least one side of the coil to exert compression forces thereon in a direction normal to the coil layers and insulation layers in the coil one side thereby compressing together the coil insulation layers in the coil one side, while continuing to exert the compression forces, altering the physical properties of the bonding material to bond the adjacent coil layers to the insulation layers therebetween to form a permanently compressed coil side, unclamping the coil, and then with one of the yoke portions not in place on the core, placing the coil on one of the core leg portions, orienting the coil such that the compressed side of the coil is disposed in the core window, and placing the one yoke portion on the core, the duct spacers being permanent duct spacers adapted to remain in the coil during use, the step of forming the coil comprising winding the conductor on a rectangular form so that the conductor is bent at four corners during winding to form the conductor layers in rectangular shapes in planes perpendicular to an axis of winding, and including the step of placing temporary duct spacers at the corners of the conductor in the ducts during winding and removing the temporary duct spacers after winding, the permanent duct spacers being positioned between the temporary duct spacers.

* * * * *